US011618661B2

(12) United States Patent
Ferranti et al.

(10) Patent No.: US 11,618,661 B2
(45) Date of Patent: Apr. 4, 2023

(54) CONTAINER OPENER

(71) Applicant: Draft Top, LLC, Long Branch, NJ (US)

(72) Inventors: Armand Joseph Ferranti, Long Branch, NJ (US); Sean Patrick Kelly, Marietta, GA (US); Alexander Armand Caracappa, Medford, MA (US); Patrick Sebastian Parizo, Hayes, VA (US)

(73) Assignee: Draft Top, Inc., Ewing, NJ (US)

( * ) Notice: Subject to any disclaimer, the term of this patent is extended or adjusted under 35 U.S.C. 154(b) by 211 days.

(21) Appl. No.: 17/324,485

(22) Filed: May 19, 2021

(65) Prior Publication Data

US 2021/0362992 A1 Nov. 25, 2021

Related U.S. Application Data

(60) Provisional application No. 63/026,956, filed on May 19, 2020.

(51) Int. Cl.
*B67B 7/46* (2006.01)
*B67B 7/00* (2006.01)

(52) U.S. Cl.
CPC ..... *B67B 7/30* (2013.01); *B67B 7/34* (2013.01); *B67B 7/36* (2013.01); *B67B 2007/303* (2013.01)

(58) Field of Classification Search
CPC .... B67B 7/34; B67B 7/36; B67B 7/00; B67B 7/24; B67B 7/30; B67B 2007/303; Y10T 83/5669; Y10T 83/5696; Y10T 83/5742; Y10T 83/576; Y10T 83/6664; Y10T 83/6665; Y10T 83/748; Y10T 83/7487; Y10T 83/7493; Y10T 83/75
USPC ..... 30/400, 358, 361, 362, 363, 366, 448
See application file for complete search history.

(56) References Cited

U.S. PATENT DOCUMENTS

| | | | | |
|---|---|---|---|---|
| 505,328 | A | 9/1893 | Pratt | |
| 638,597 | A * | 12/1899 | Richmond | |
| 643,961 | A | 2/1900 | Hanten et al. | |
| 1,326,707 | A * | 12/1919 | Bergendorf et al. | B67B 7/24 30/448 |
| 1,474,466 | A | 11/1923 | Felton | |
| 1,922,630 | A | 8/1933 | Oberhuber | |
| 2,579,912 | A | 12/1951 | Donnelly | |
| 2,674,911 | A | 4/1954 | Theis | |
| 2,725,622 | A * | 12/1955 | Geier | B67B 7/24 30/447 |
| 2,749,612 | A | 6/1956 | Blue | |
| 2,814,015 | A | 11/1957 | Kuhrt | |

(Continued)

FOREIGN PATENT DOCUMENTS

| | | | |
|---|---|---|---|
| GB | 2161449 | B | 5/1988 |
| JP | 2005082241 | A | 3/2005 |

(Continued)

OTHER PUBLICATIONS

Screen captures from Aug. 13, 2021, for https://www.facebook.com/people/Can-Cutter/100042945584293/.

*Primary Examiner* — Phong H Nguyen
(74) *Attorney, Agent, or Firm* — Duane Morris LLP

(57) ABSTRACT

The disclosure relates to a container opener for opening a planar portion of a sealed container by cutting the planar portion of the container, while leaving little to no sharp edges on the container at the point of the cut.

20 Claims, 22 Drawing Sheets

SECTION B-B

(56) References Cited

U.S. PATENT DOCUMENTS

| | | | | |
|---|---|---|---|---|
| 2,814,105 | A | 11/1957 | Smith | |
| 3,517,440 | A * | 6/1970 | Omer | B67B 7/24 30/448 |
| 4,125,941 | A | 4/1978 | McKinley | |
| 4,133,228 | A | 1/1979 | Depooter | |
| 4,155,160 | A | 5/1979 | Bobo | |
| 4,177,559 | A | 12/1979 | Anderson | |
| 4,279,077 | A | 7/1981 | Freeman | |
| 4,633,589 | A | 1/1987 | Gray | |
| 4,648,183 | A | 3/1987 | Jacobs | |
| 5,228,203 | A | 7/1993 | Hahn | |
| 5,581,897 | A | 12/1996 | Liebscher | |
| 6,000,262 | A | 12/1999 | Dries et al. | |
| 6,935,208 | B1 | 8/2005 | Cruthirds | |
| 8,695,457 | B2 | 4/2014 | Rozmus | |
| 8,833,209 | B2 | 9/2014 | Brown | |
| 10,519,016 | B2 | 12/2019 | Kelly et al. | |
| 2005/0028646 | A1 | 2/2005 | Hefti et al. | |
| 2006/0117462 | A1 | 6/2006 | Wysopal | |
| 2007/0143929 | A1 | 6/2007 | Selin | |
| 2008/0307659 | A1 | 12/2008 | Freeman | |
| 2015/0014354 | A1 * | 1/2015 | Kellenberger | B65D 81/3876 222/83 |
| 2017/0355583 | A1 | 12/2017 | Kelly et al. | |

FOREIGN PATENT DOCUMENTS

| | | | |
|---|---|---|---|
| KR | 20-0451810 | Y1 | 1/2011 |
| KR | 10-1402038 | B1 | 6/2014 |

* cited by examiner

Section A-A

SECTION B-B

CONTAINER OPENER

CROSS REFERENCE TO RELATED APPLICATIONS

This application claims the benefit of provisional patent application Ser. No. 62/026,956 titled "CONTAINER OPENER" filed May 19, 2020, the entirety of each of which is hereby incorporated by reference herein.

FIELD

The present disclosure generally relates to the technical field of cutlery and bar utensils, and in particular, an apparatus and method for opening a planar portion of a sealed container.

BACKGROUND

Traditional opening devices may remove a planar upper surface of a sealed container; however, these devices are limited in the types of containers they can open and are constrained in the method of accessing the container contents.

A recent trend among soda or beverage cans, e.g., beer cans, is to engage the installed tab located at the planar top surface of the can while including a perforated indentation opposite the tab to improve flow of the soda or beverage from the can once opened. However, this conventional technique requires a separate tool, such as a key or other instrument, to puncture the perforated indentation. In addition, for applications in a bar or concession environment, the two-step process of this conventional technique is cumbersome or impractical that inhibits a bartender or concession worker from quickly opening and delivering the container. Moreover, engaging the installed tab and puncturing the perforated indentation may only increase flow of the soda or beverage from the can based on the limited dimensions of the tabbed mouth opening. For example, the perforated indentation constrains the flow of denser liquids. Concurrently, the developmental costs for changing and implementing a perforated indentation design are impractical for the limited amount of target consumers. Moreover, the conventional installed tab, the conventional installed tab and perforated indentation, or traditional opening devices may create a small opening in the container. However, this small opening hinders the user from smelling the full aroma of the container contents, e.g., beer, thereby effecting the user's sense of taste.

Additionally, traditional opening devices, either manually operated or machine operated, may present various access challenges for planar top containers without an engagement tab or mouth. For example, manually operated opening devices use a single blade to remove the entire planar upper surface. These conventional devices require many rotations of a handle or crank to utilize the single blade to cut around the entire circumferential edge of the container. In another example, machine operated opening devices are limited by the speed of the motor during the opening process. Furthermore, both the manually operated and machine operated devices require a user to align and engage the single blade along the circumferential edge before commencing the opening process, which is both time consuming and cumbersome. Moreover, the distance that the shoulder or lip of various containers protrudes outward from the engagement point of the blade can make the opening device ineffective by not allowing the blade to puncture and engage the container surface at an appropriate angle.

Additionally, although traditional manually operated and machine operated devices remove the planar upper surface of a container, these devices leave sharp edges on the container upon removal that are harmful to the user. The contents of such containers subsequently need to be removed to an intermediate container for user safety following the opening process.

SUMMARY

A container opener is provided. The container opener includes a handle operatively coupled to a base. In one or more cases, the base includes a first surface sized to receive a portion of a container. In one or more cases, the base includes a cutter head having a blade. In one or more cases, the base includes an actuating mechanism operatively coupled to the handle and cutting head. In one or more cases, the container opener includes an engagement member having a second surface sized to receive another portion of the container. In one or more cases, a shape of the second surface is complimentary to a shape of the first surface of the base. In one or more cases, the actuating mechanism is configured to translate a rotational movement of the handle to a movement of the cutter head in a vertical direction of the container opener and to a movement of the second surface in a horizontal direction of the container opener.

A device is provided that includes a handle operatively coupled to a base. In one or more cases, the base includes a first surface and a second surface forming a hollow sized to receive a portion of a container. In one or more cases, the base includes a cutter head having a blade. In one or more cases, the base includes an actuating mechanism operatively coupled to the handle and cutting head. In one or more cases, the actuating mechanism is configured to translate a rotational movement of the handle to a movement of the cutter head in a vertical direction of the container opener and to a movement of the second surface in a horizontal direction towards the first surface.

A method is provided that includes positioning a container within a hollow of a base of a device. In one or more cases, the hollow is formed by a first surface and a second surface of the base. In one or more cases, the method includes rotating a handle of the device in a first downward direction causing the first surface and second surface to engage and position the container within the hollow. Further, rotating a handle of the device in the first downward direction causes a cutter head of the device to translate in a second downward direction to pierce a surface of the container and to fold a cut portion of the surface inward. In one or more cases, the method includes rotating the handle in a first upward direction causing the first surface and second surface to disengage the container. Further, rotating the handle in the first upward direction causes the cutter head to translate in a second upward direction. In one or more cases, the second upward direction is opposite the second downward direction.

BRIEF DESCRIPTION OF FIGURES

The following drawings are illustrative of particular embodiments of the present disclosure and therefore do not limit the scope of the present disclosure. The drawings are not to scale and are intended for use in conjunction with the explanations in the following detailed description.

DESCRIPTION

Figure 1:
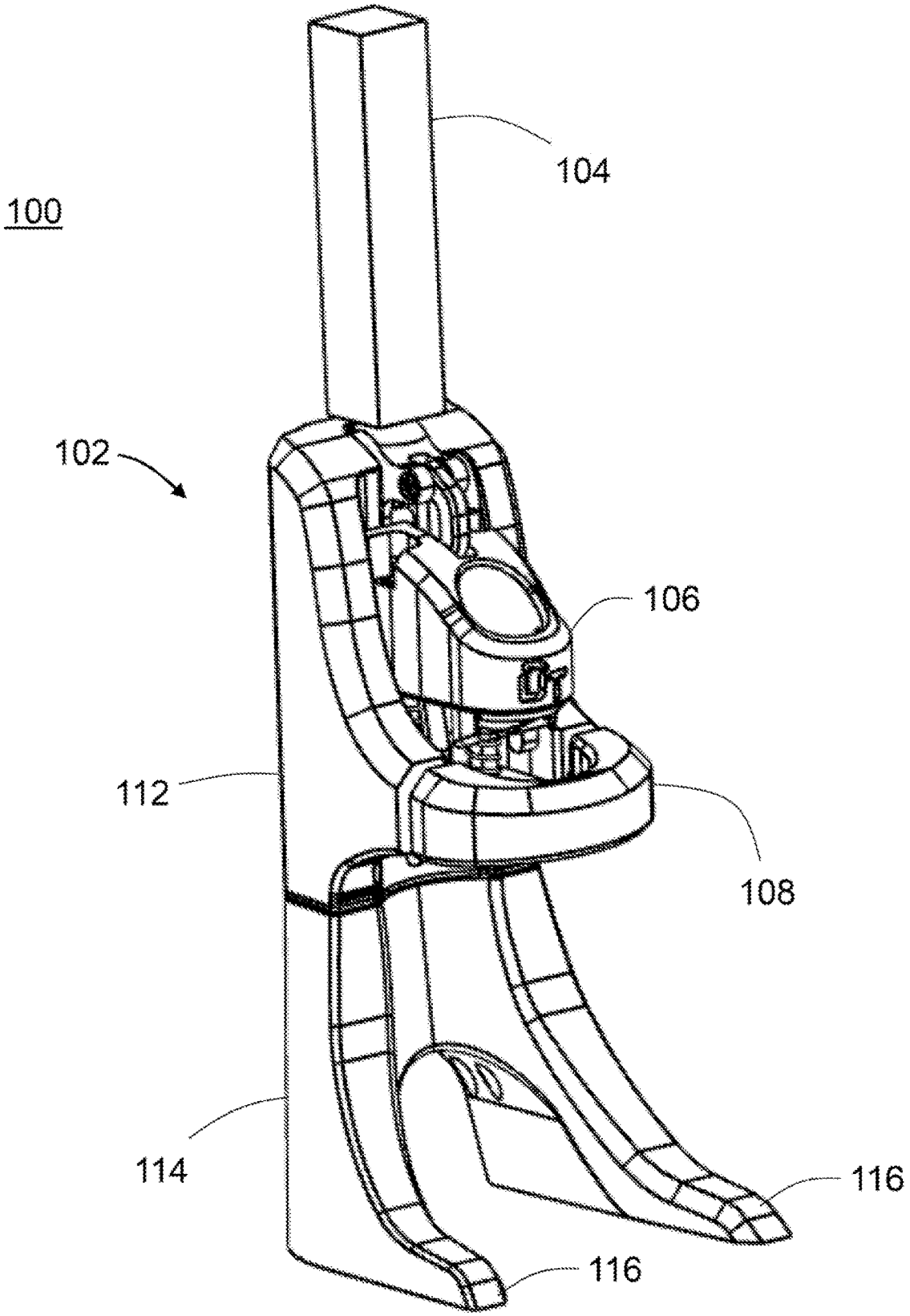
FIG. 1 is a perspective view of an example apparatus in an unactuated position for opening a sealed contained.

The following discussion omits or only briefly describes conventional features of container opening devices that are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest reasonable interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Moreover, the drawing figures are not necessarily to scale and certain features may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The embodiments described herein are directed to opening sealed containers, such as sealed cans, which permit the user to separate a portion or an entire upper planar surface of the container from a pressed outer edge or rim of the container.

Additionally, by way of example, the embodiments described herein permit the user to safely open and/or remove the upper planar surface of a sealed container with both ease and efficiency. Further, by way of example, the embodiments described herein permit the user to open and/or remove the entire upper planar surface of such container with minimal resulting sharp edges. Moreover, the embodiments described herein permit the user to smell the full aroma of the container contents, e.g., beer, thereby allowing the user to fully enjoy the taste of the container contents.

Figure 2:
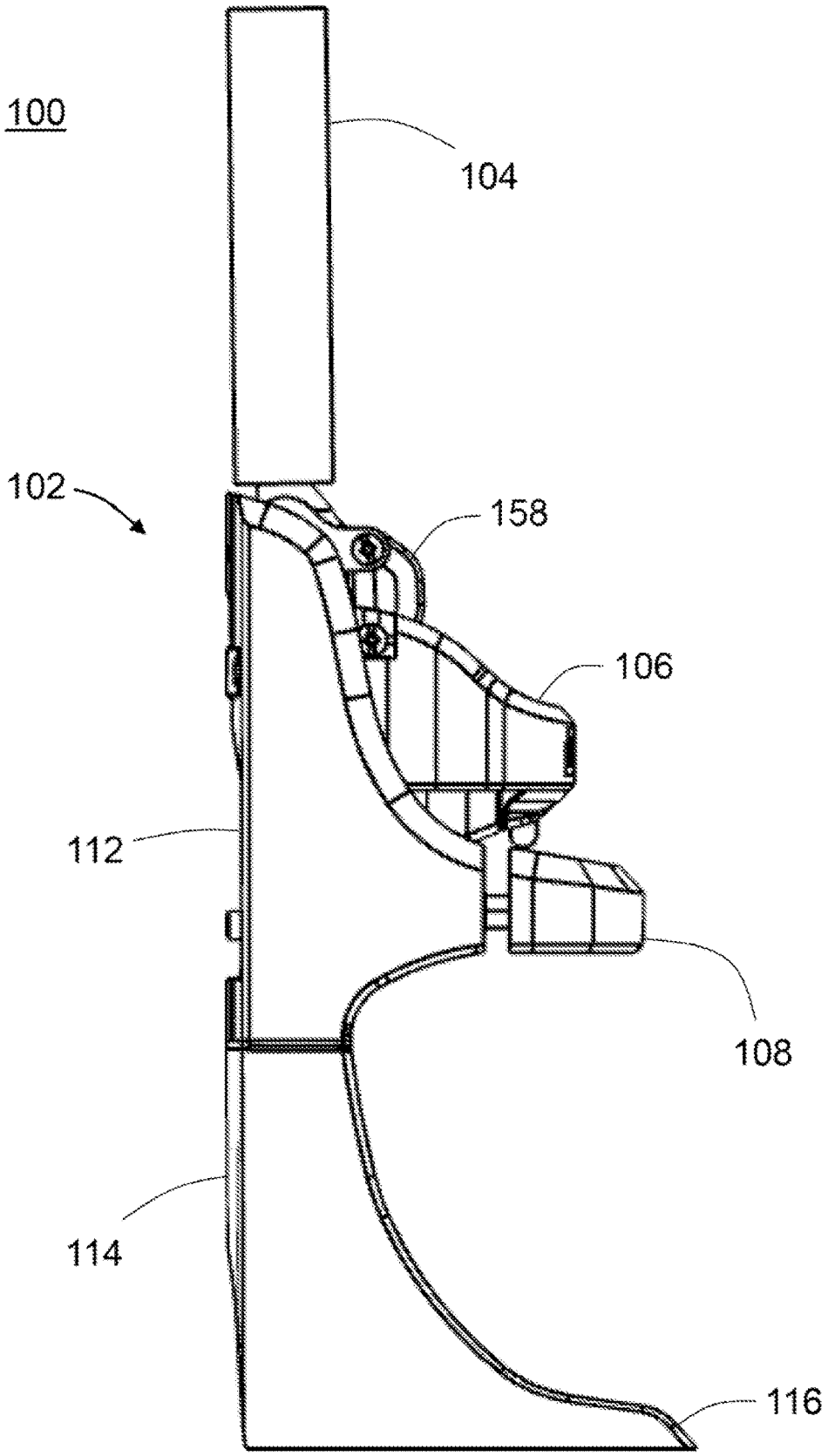
FIG. 2 is a left side view of the apparatus of FIG. 1.
Figure 3:
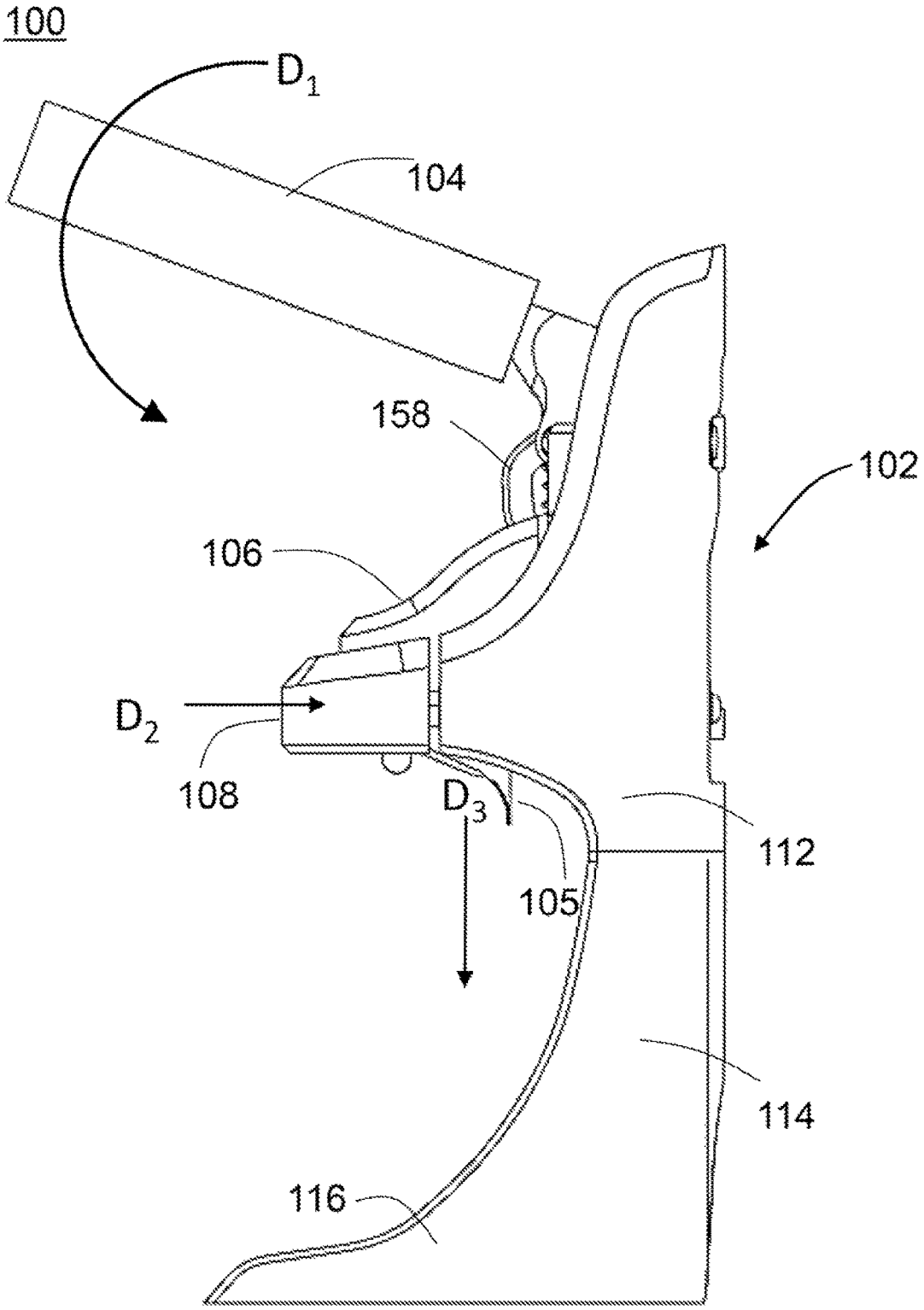
FIG. 3 is a right side view of the apparatus of FIG. 1 in an actuated position.
Figure 4:
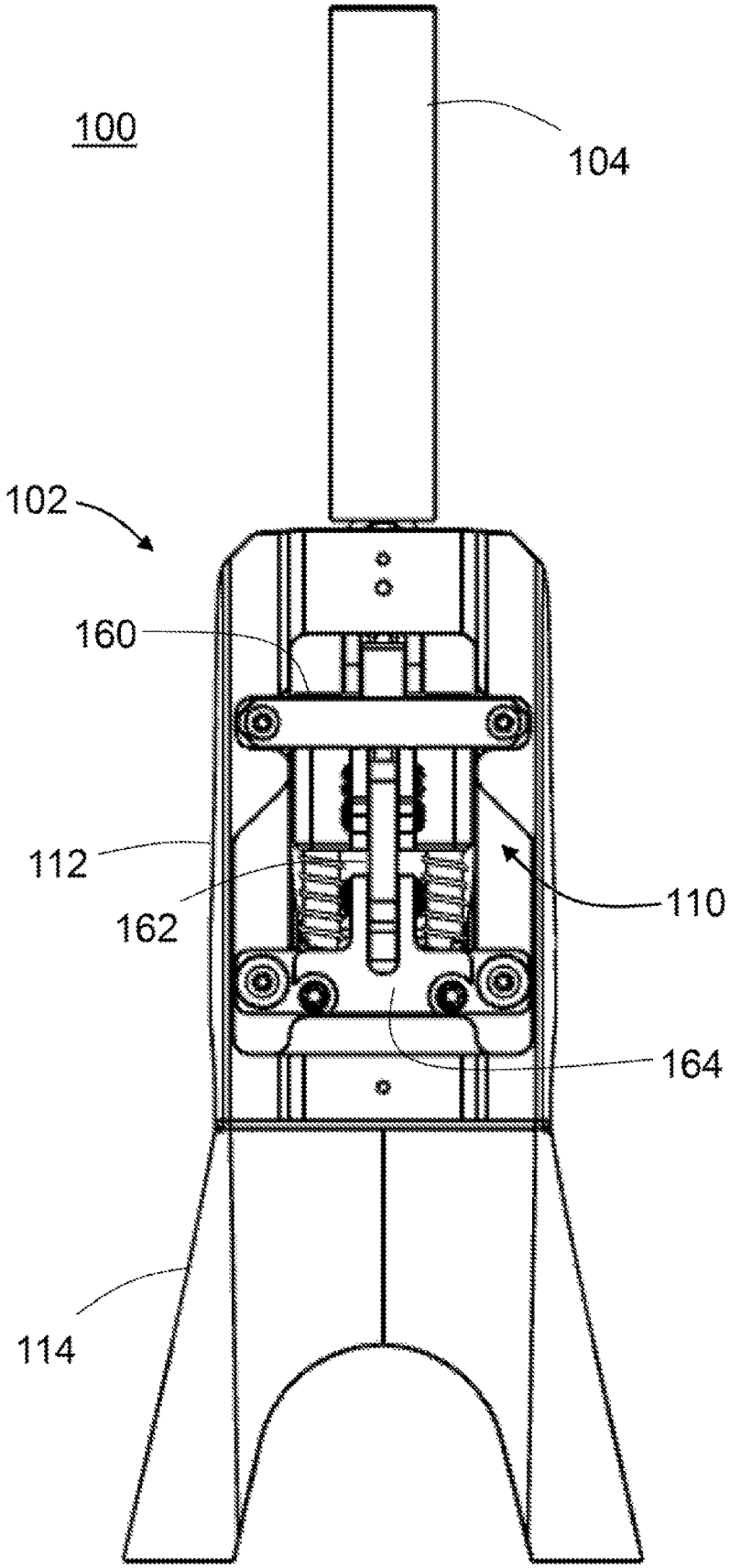
FIG. 4 is a rear view of the apparatus of FIG. 1.
Figure 5:
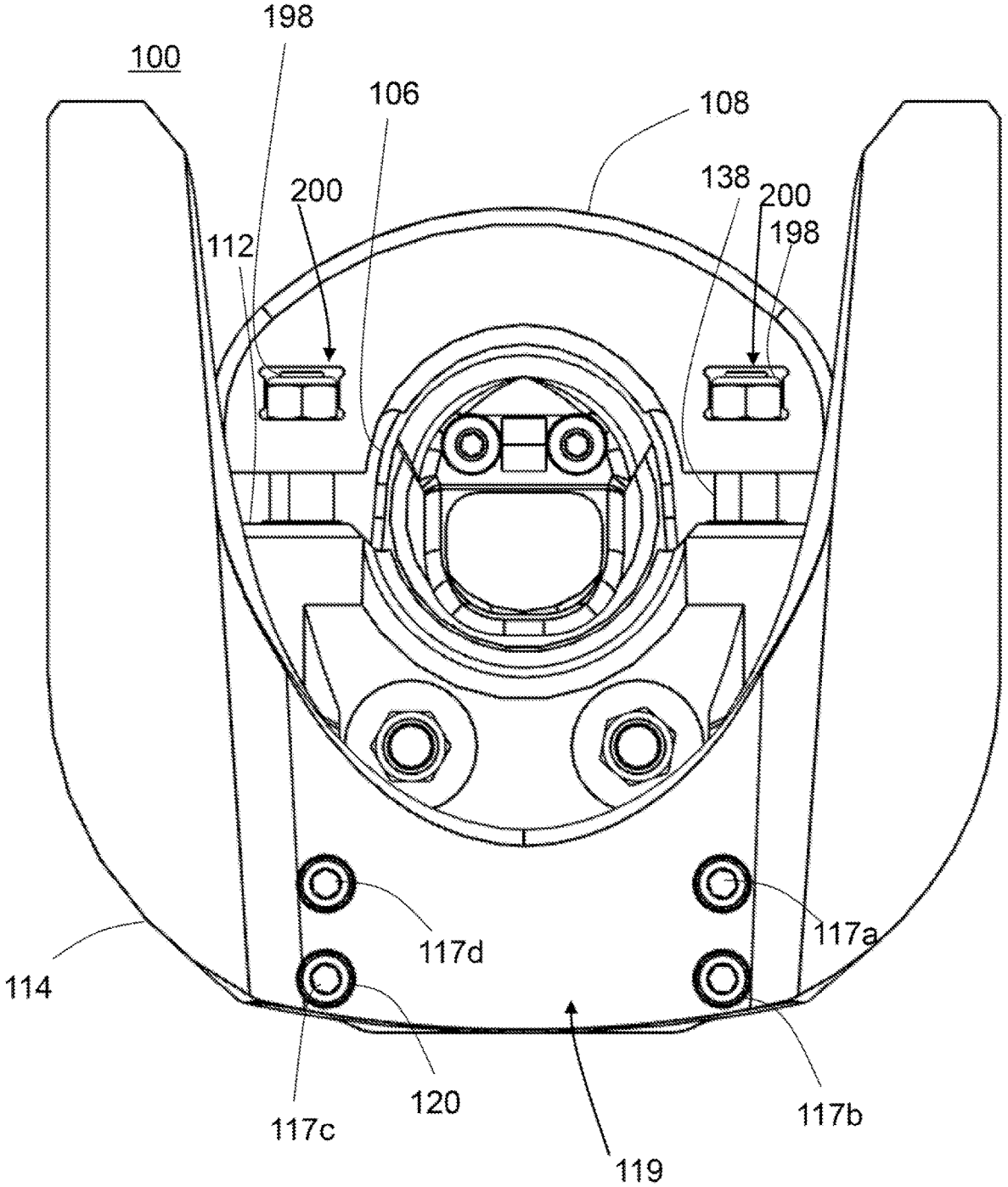
FIG. 5 is a bottom view of the apparatus of FIG. 1.
Figure 6:
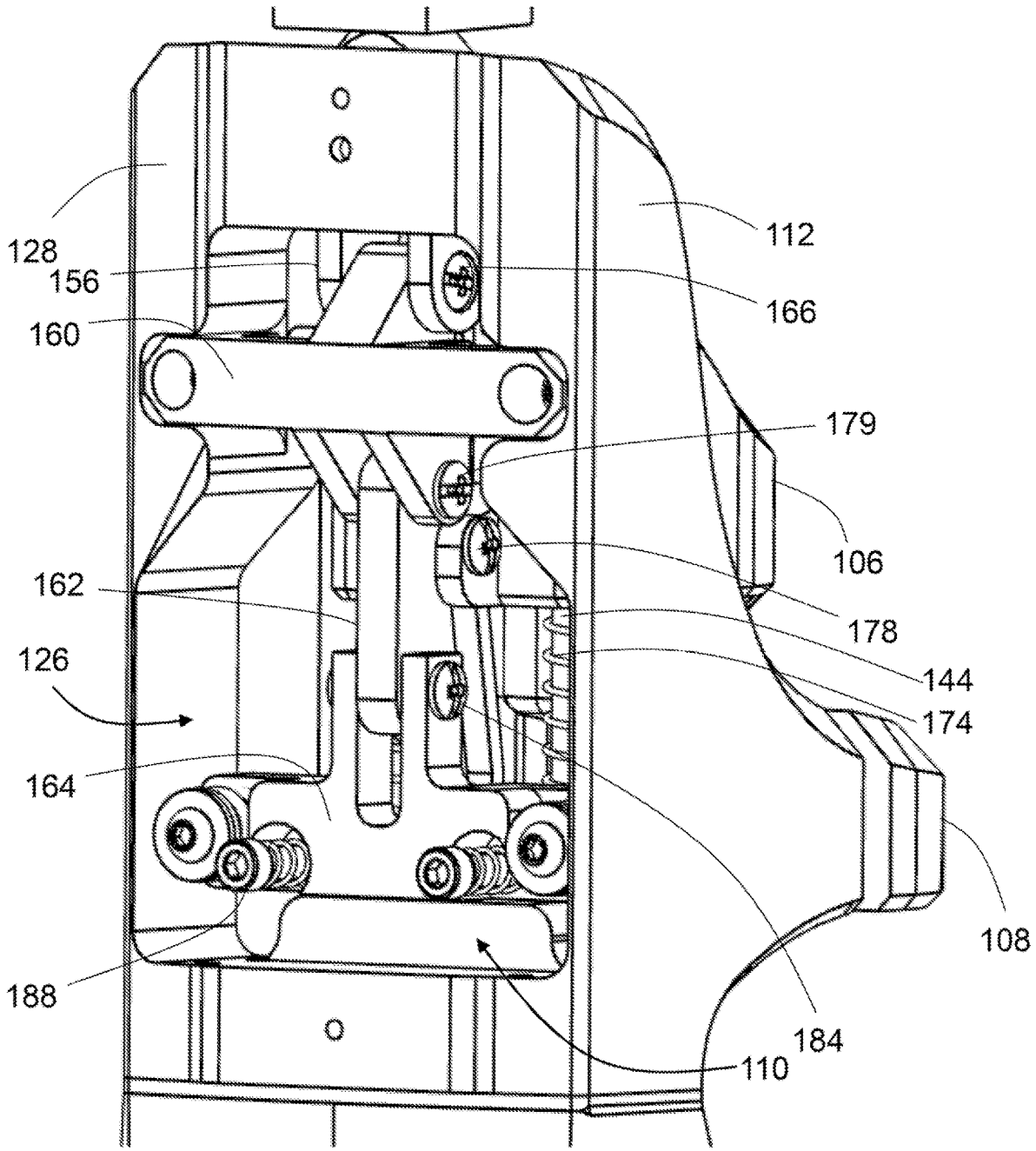
FIG. 6 is a rear perspective view of an actuation mechanism of the apparatus of FIG. 1.

FIGS. 1-5 illustrate an apparatus 100 for opening a planar portion of a sealed container, such as, for example, a beverage (e.g., soda, beer, and the like) can. Although the embodiments are discussed with respect to an example beverage can, the embodiments and examples described herein are not limited to beverage cans, but may include other sealed containers, such as but not limited to, food cans (e.g., soup, fruit, and other like cans), paint cans, and the like. FIG. 1 is a perspective view of the apparatus 100 in an unactuated position, FIG. 2 is a left side view, FIG. 3 is a right side view in an actuated position, FIG. 4 is a rear view, and FIG. 5 is a bottom view of the apparatus 100. The apparatus 100 includes a base 102, a handle 104, a cutter head 106, an engagement member 108, and an actuation mechanism 110.

Figure 11:
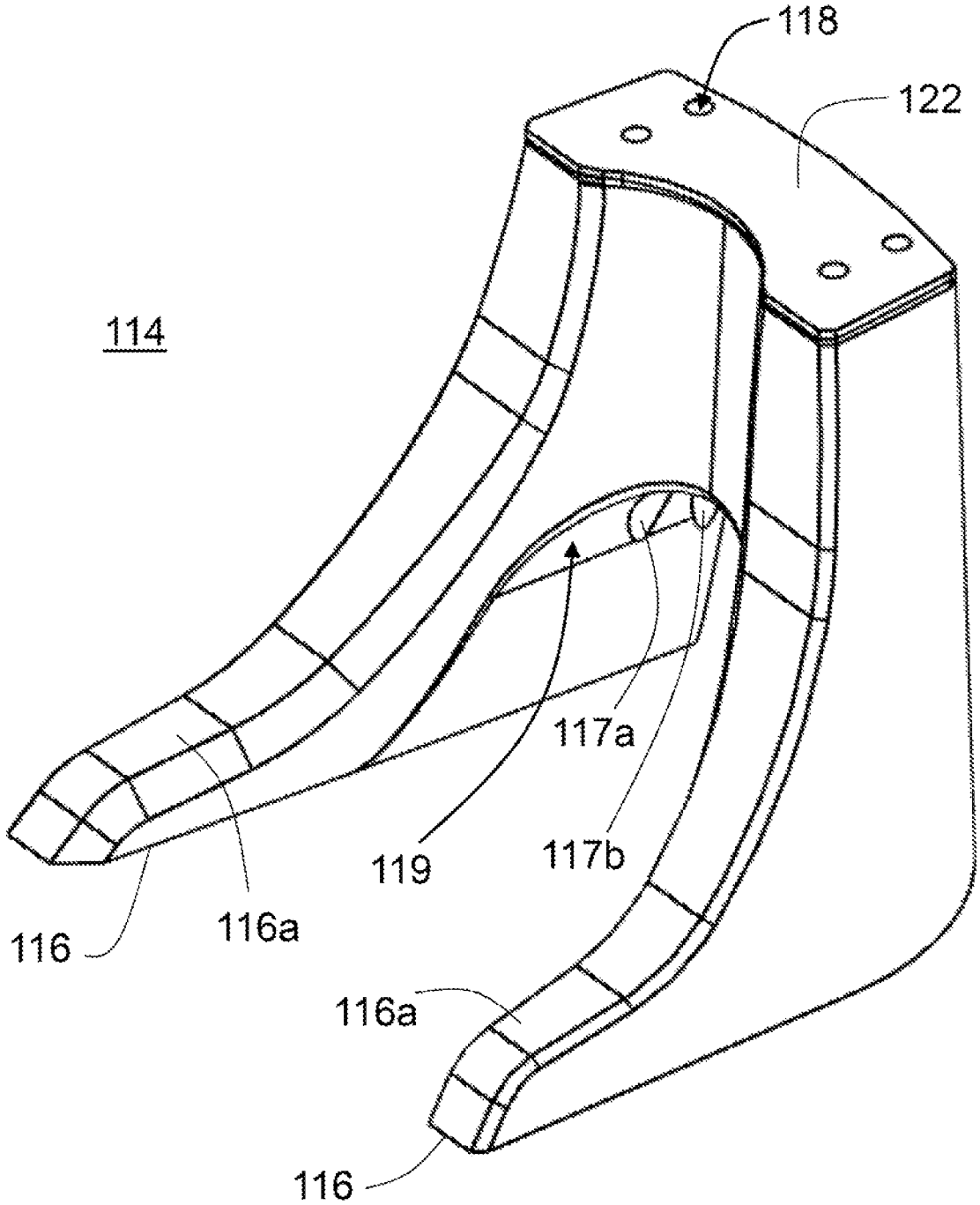
FIG. 11 illustrates a front perspective view of a lower base of the apparatus of FIG. 1.

The base 102 supports the apparatus 100. In one or more cases, the base 102 includes an upper base 112 and a lower base 114 that can be coupled together in any appropriate manner (e.g., screws, bolts or other fasteners). FIG. 11 illustrates the lower base 114 in more detail. The lower base 114 includes feet 116 sized to be placed on a bar, countertop, or other support surface to support the apparatus 100. In one or more cases, the feet 116 define one or more holes (not shown) on a top surface 116*a* of the feet 116, for receiving screws, bolts, or other fasteners to couple the lower base 114 to a surface of the bar, countertop, or other support surface. The lower base 114 defines one or more holes 118, such as holes 117*a*, 117*b*, 117*c*, and 117*d*, for receiving screws, bolts or other fasteners 120 (shown, for example, in FIG. 5) to couple the lower base 114 to the upper base 112. The holes 118 extend from a lower surface 119 of the lower base 114 through an upper surface 122 upon which the upper base 112 sits.

Figure 12:
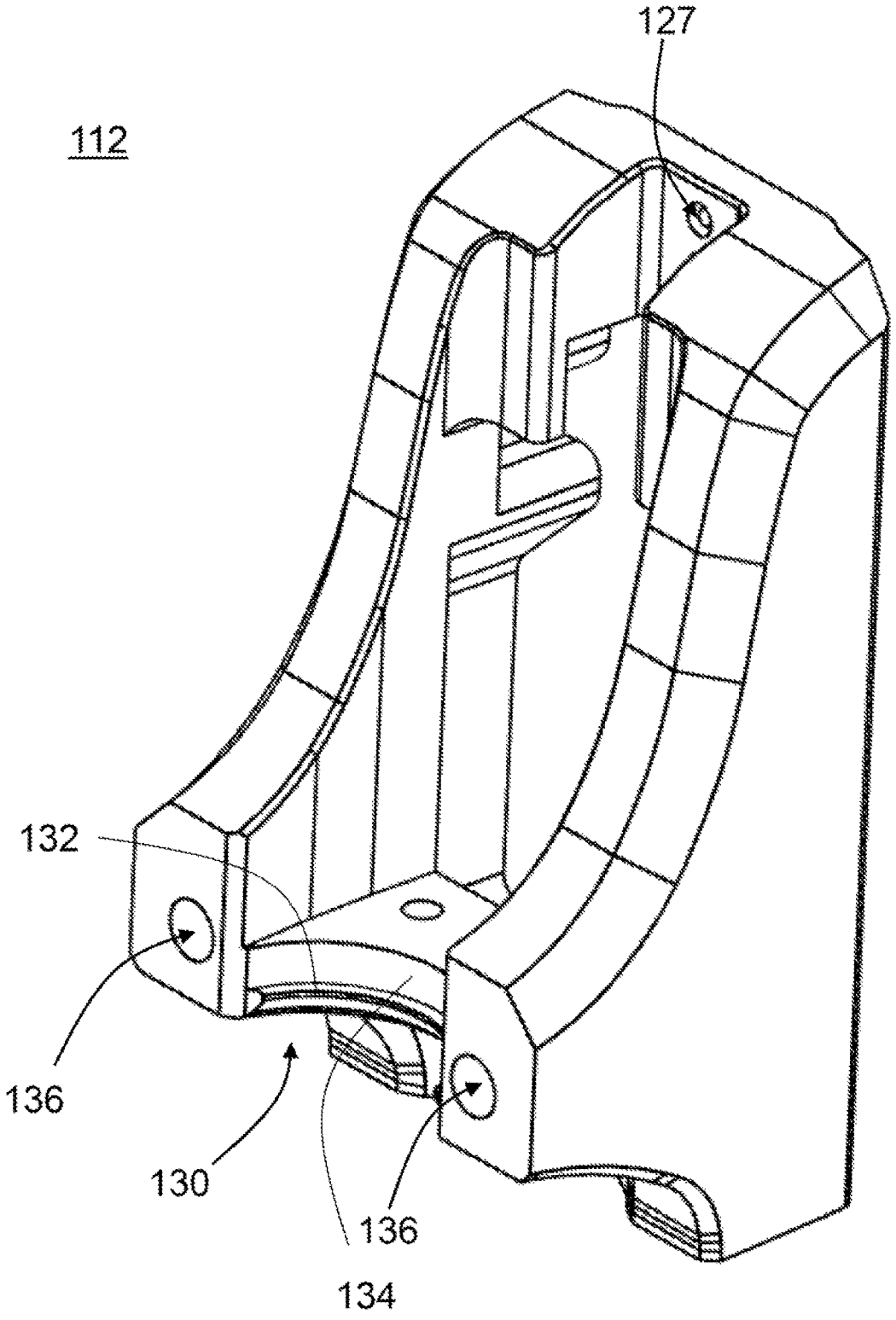
FIG. 12 illustrates a front perspective view of an upper base of the apparatus of FIG. 1.
Figure 13:
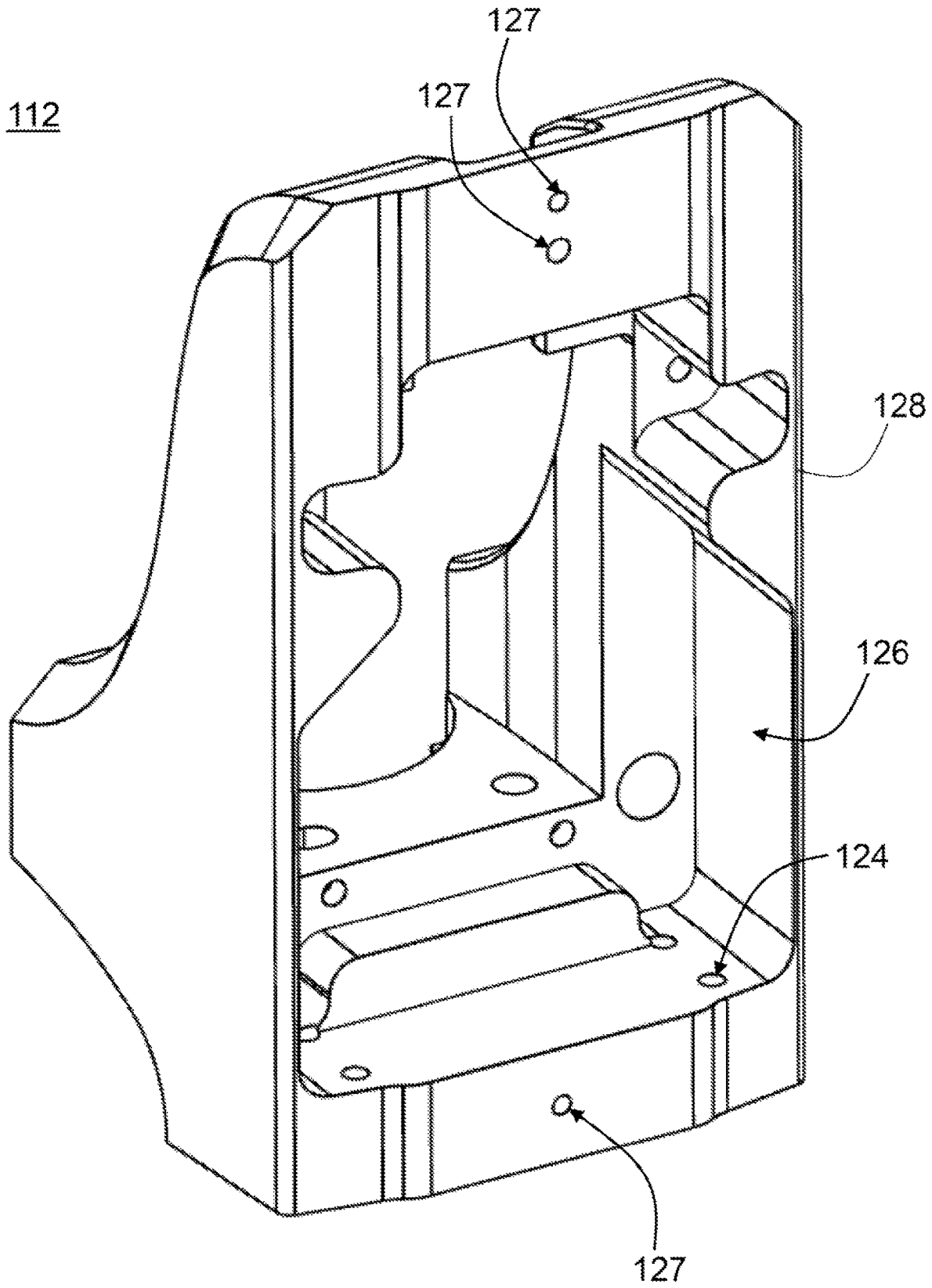
FIG. 13 illustrates a rear perspective view of the upper base of FIG. 12.

FIGS. 12 and 13 illustrate the upper base 112 in more detail. FIG. 12 illustrates a front perspective view of the upper base 112, and FIG. 13 illustrates a rear perspective view of the upper base 112. The upper base 112 defines one or more holes 124 for receiving the fasteners 120 to couple the upper base 112 to the lower base 114. The upper base 112 defines one or more holes 127 extending from a front surface of the upper base 112 to the rear surface 128 of the upper base 112 for receiving screws, bolts, or other fasteners to couple the upper base 112 to a wall or other vertical surface. In one or more cases, by coupling the upper base 112 to a wall or other vertical surface, the base 102 may include the upper base 112 and not the lower base 114.

The upper base 112 further defines a rear cavity 126 extending into the upper base 112 from the rear surface 128. In one or more cases, the rear cavity 126 is sized and dimensioned to receive and locate portions of the actuation mechanism 110. The upper base 112 further defines a semi-circular hollow 130 in the front of the upper base 112. In one or more cases, the hollow 130 may be sized and dimensioned to receive a portion of an outer edge or rim of a container. In one or more cases, the hollow 130 includes a lip 132 extending outwards from the face 134 of the hollow 130. In one or more cases, the lip 132 engages a container positioned in the hollow 130. The lip 132 supports the can while the apparatus 100 is used to separate a portion or an entire top surface from the container. The upper base 112 further includes bores 136 in the front of the upper base 112. As will be described in more detail herein, the bores 136 receive posts 138 (shown in FIG. 9) that support the engagement member 108.

As illustrated in FIGS. 1-4, the handle 104 may be an elongated member that a user can grasp to actuate the apparatus 100 to remove a top of a beverage container. In one or more cases, the handle can be actuated similar to a tap handle commonly found in bars and restaurants. In other words, a user grasps the handle 104 and rotates the top of the handle 104 downward in direction $D_1$ and toward the front of the apparatus 100 to operate the apparatus 100. The handle 104 may be removable and replaceable such that the apparatus 100 can be customized—for example, by adding a handle that is branded to a specific beverage company or bar/restaurant. In one or more cases, the handle 104 is coupled to a first member 156 of the actuation mechanism 110 in a same or similar manner as a tap handle (i.e., a faucet handle) is coupled to a faucet of a tap. As such, the first member 156 may be configured to receive a standard tap handle.

Figure 15:
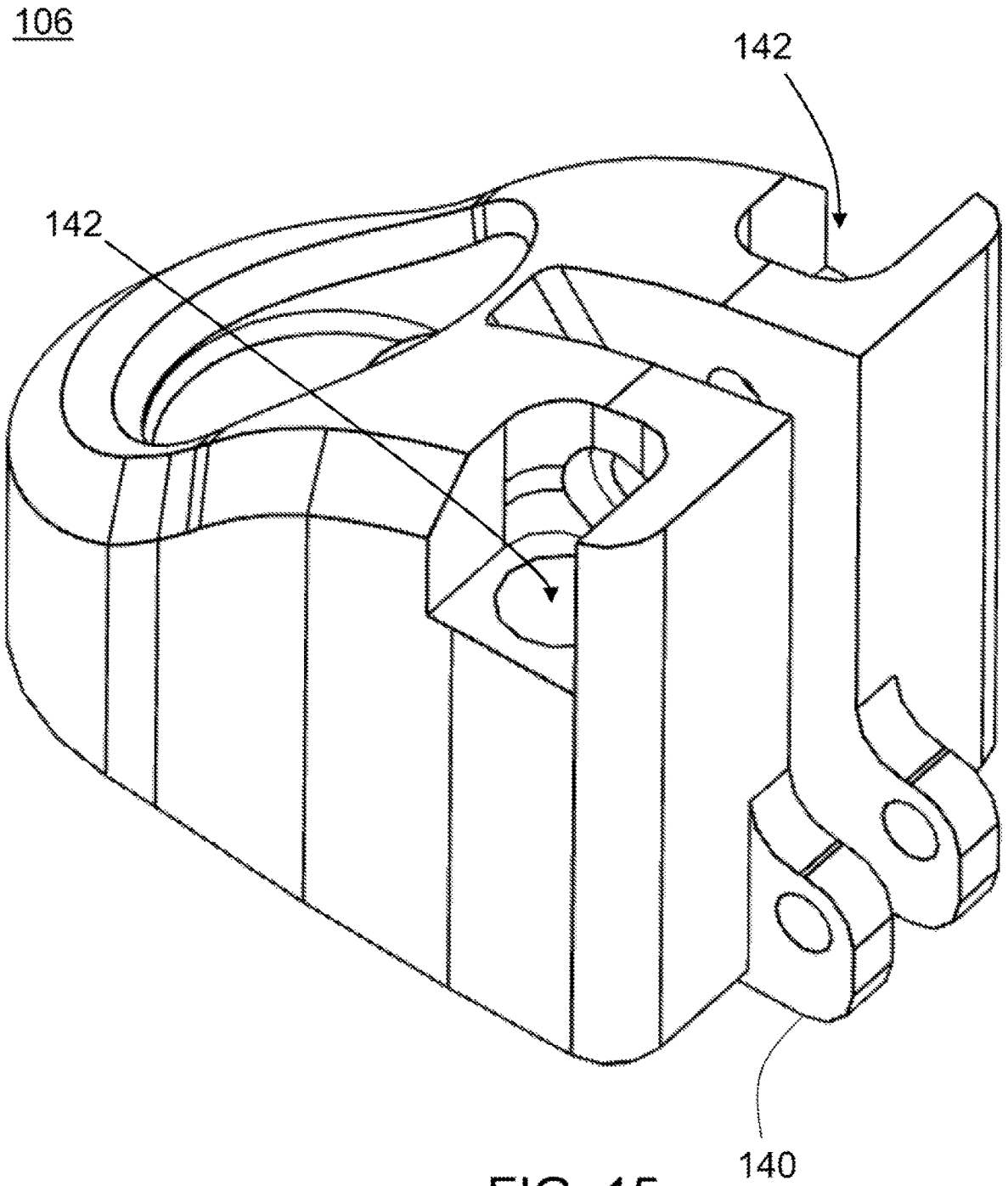
FIG. 15 is a perspective view of an example cutter head.
Figure 16:
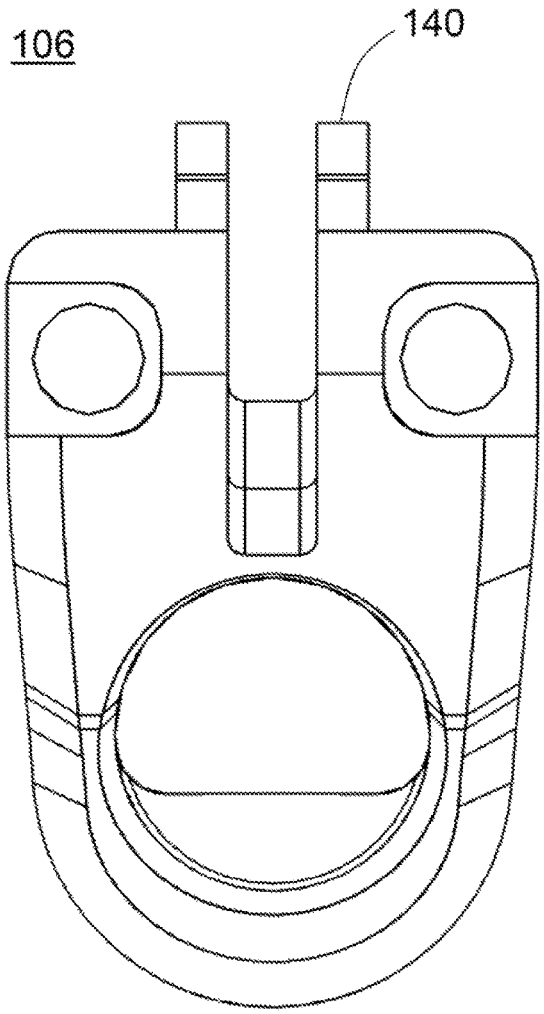
FIG. 16 is a top view of the cutter head of FIG. 15.
Figure 17:
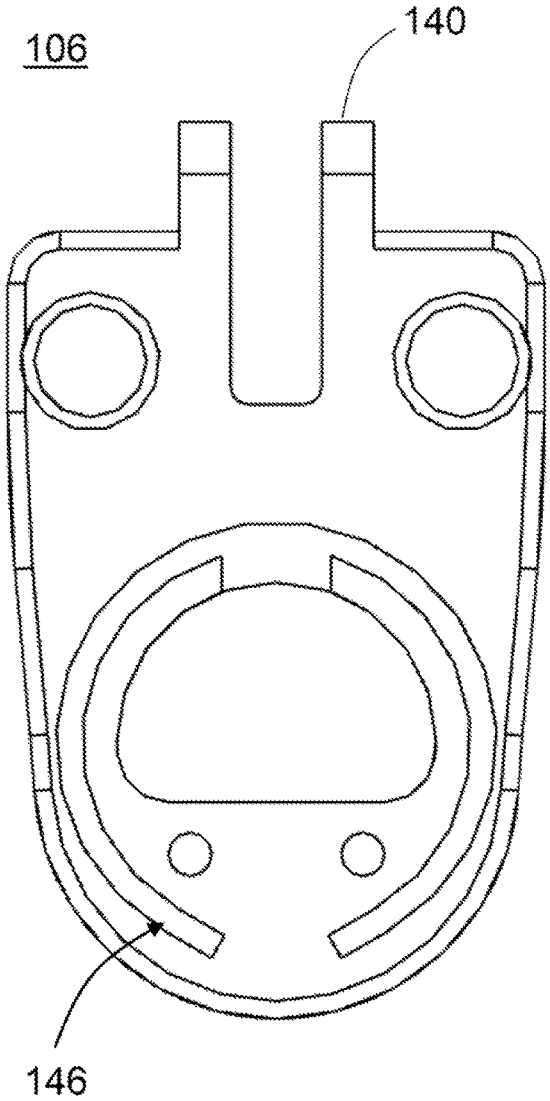
FIG. 17 is a bottom view of the cutter head of FIG. 15.
Figure 18:
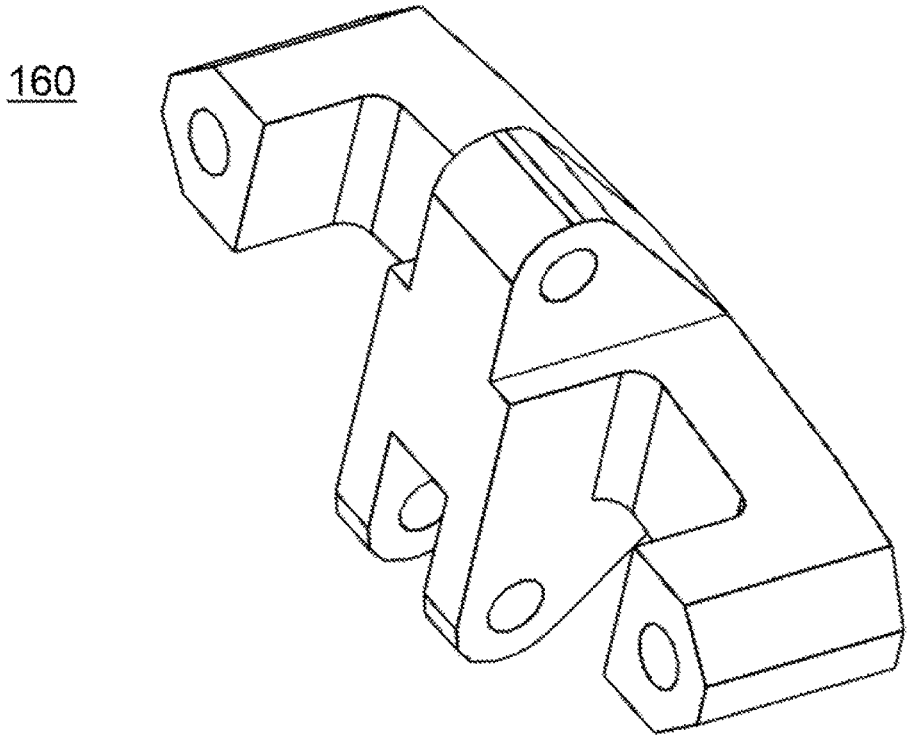
FIG. 18 illustrates a detailed view of a coupler.

The cutter head 106 is shown in detail in FIGS. 15-17. FIG. 15 is a perspective view of the cutter head 106, FIG. 16 is a top view of the cutter head 106, and FIG. 17 is a bottom view of the cutter head 106. The cutter head 106 includes lugs 140 configured to couple the cutter head 106 to the actuation mechanism 110, as described herein. The cutter head 106 further includes bores 142 configured to receive posts 144 (shown in FIG. 10) to guide the motion of the cutter head 106 in a direction $D_3$ (shown in FIG. 3) during operation, as described herein. The cutter head 106 further defines a slot 146 extending into the bottom of the cutter head 106 to receive a cutting blade 105 to engage and cut the top of the beverage container. In one or more cases, the cutting blade 105 may be removably coupled to the cutter head 106, such that the cutting blade 105 may be replaced with another cutting blade 105. The cutting blade defines one or more holes 107 for receiving screws, bolts, or other fasteners, such as fasteners 109 (illustrated in FIG. 23), to removably couple the cutter head 106 and the cutting blade 105. In one or more other cases, the cutting blade 105 may be integrally formed with the cutter head 106, such that the cutting blade 105 is permanently fixed to the cutter head 106. In one or more cases, the cutter head 106 includes a rigid protrusion 129 extending outwards from the bottom of the cutter head 106 in the direction $D_3$. The protrusion 129 may be positioned away from the cutting blade 105. The protrusion 129 may be configured to push a cut portion of a surface of a container into the container. The protrusion 129 may be formed in any shape and/or have any length such that the cut surface of the container may be folded into the container. In some cases, the protrusion 129 is integrally formed with the cutter head 105. In other cases, the protrusion 129 may be removably coupled to the cutter head 105.

Figure 22:
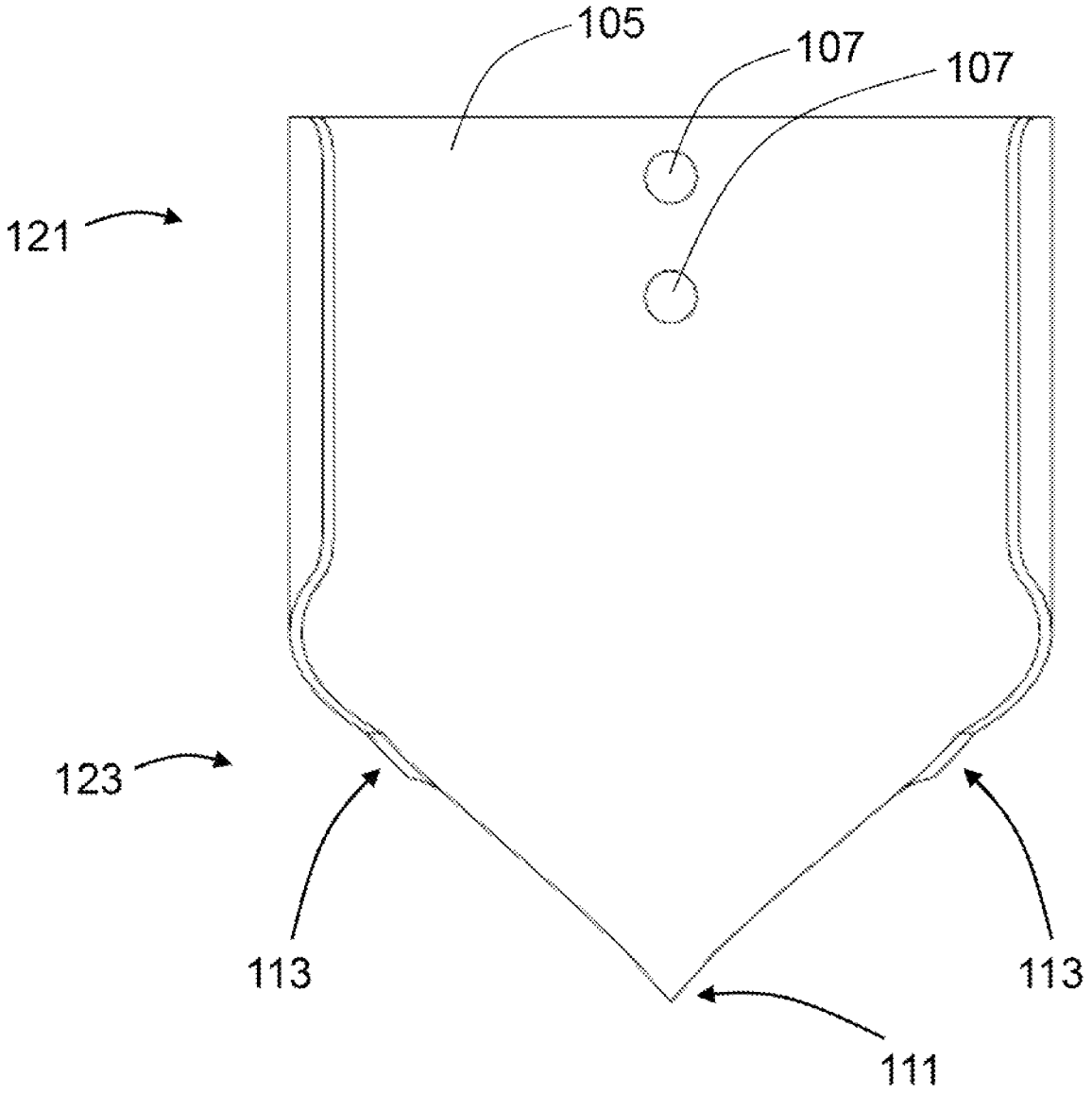
FIG. 22 illustrates a rear view of a cutting blade.
Figure 23:
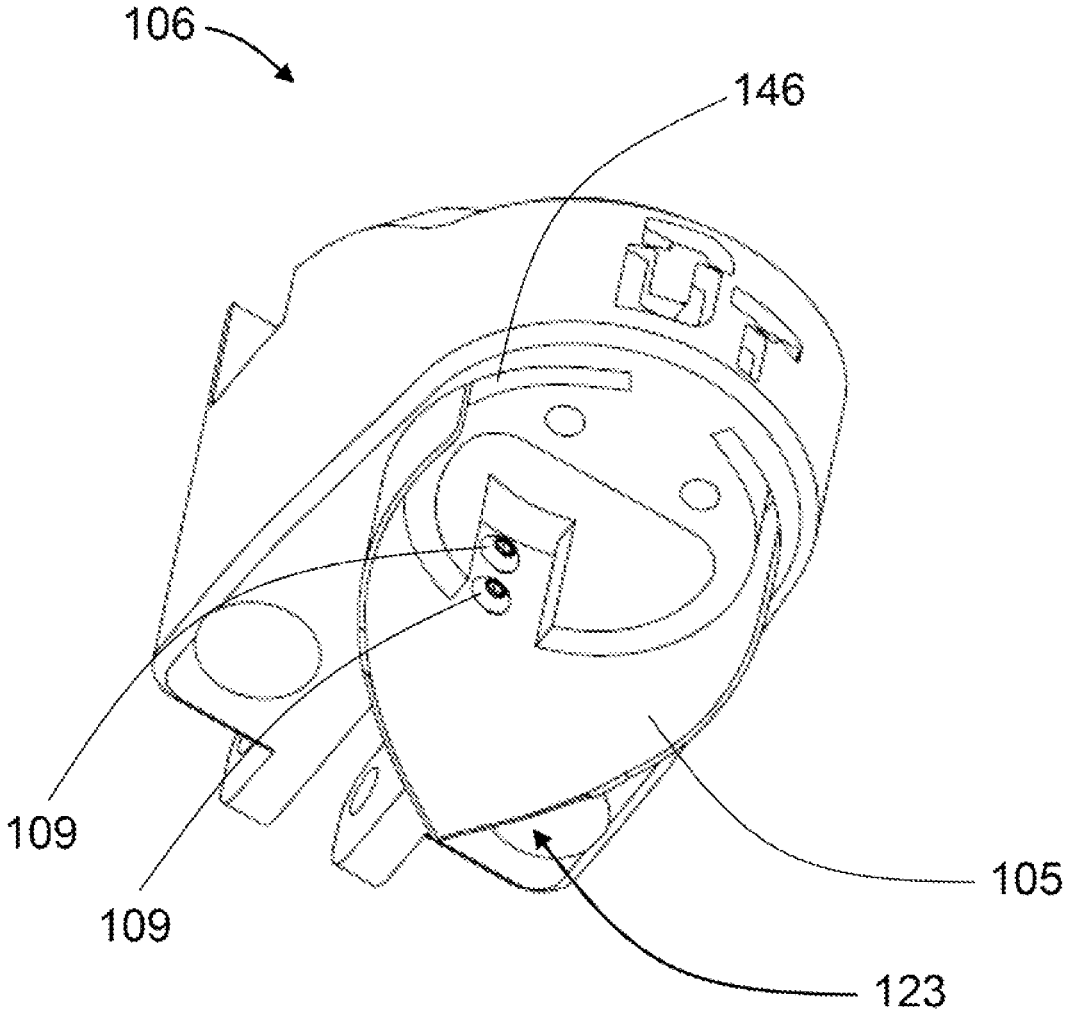
FIG. 23 illustrates a lower front perspective view of the example cutter head.

The cutting blade 105 may be formed in a shape that corresponds to the shape of slot 146. For example, for the cases in which the slot 146 has a cylindrical shape, the attachment end 121 of the cutting blade 105 may be formed in a cylindrical shape to fit within the slot 146. The attachment end 121 may include the one or more defined holes 107 for receiving fasteners to couple the cutting blade 105 with the cutter head 106. The cutting blade 105 may include a piercing end 123 (as shown in FIGS. 22 and 23) disposed on an end portion of the cutting blade 105 that is opposite the attachment end 121. The outer perimeter of the piercing end 123 may taper from the attachment end 121 to a point 111 of the cutting blade 105. The point 111 may have a sharp pointed end capable of piercing a portion of a surface, for example, but not limited to, a top planar surface of a container. The point 111 may begin at the tip of the piercing end 123 and extend to folding edges 113 disposed on the end of the piercing end 123 opposite the point 111. The folding edges 113 (as shown in FIG. 22) may be formed in a shape such that as the point 111 pierces the surface of the container and cuts the surface of the container, the folding edges 113 fold the cut portions attached to the container inward during the cutting action, allowing the cutting blade 105 to leave little to no sharp edges at the point of the cut. For example, the folding edges 113 may be curved at a different angle or arched in a different manner than the point 111. It should be noted that cutting blade 105 is illustrated as having one piercing end, for example, piercing end 123; however, it should be understood that cutting blade 105 may include multiple piercing ends disposed around the end portion of the cutting blade 105. For example, the cutting blade 105 may have two or three piercing ends, and as such, including a respective number of points, for example two or three points 111, or one point 111 per piercing end 123. In one or more cases, by including more piercing ends 123 on the cutting blade 105, the apparatus 100 may cut the container with a rotation of the handle 104 that is less than a rotation of the handle 104 for the cases in which the cutting blade 105 includes one piercing end 123.

In one or more cases, the cutting blade 105 may be made of metal, high-strength plastic, or any suitably rigid and strong material. For example, the cutting blade 105 may be made of aluminum. In another example, the cutting blade 105 may be made of a metal harder than aluminum with corrosion resistant properties. In one or more cases, the cutting blade 105 may be formed in a shape that cuts a portion of the container and leaves another portion of the surface of the container attached to the container, such that the cutting blade 105 may fold the cut portion downward into the container, and leave the cut portion attached to the container by the uncut portion of the top surface. In one or more other cases, the cutting blade 105 may be formed in a shape that cuts a portion of the top surface of the container, such that the cut portion is entirely removed from the container upon completion of the cutting action.

Although the cutter head 106 is configured to open a container via cutting blade 105 as described herein, it should be noted that the cutter head 106 may be adapted to utilize one or more components of device 10 (for example, but not limited to, blades 28, 30, 32, and 34), device 70 (for example, but not limited to, blades 88, 90, 92, and 94), device 204 (for example, but not limited to, blades 240, 242, 244, and 246), or device 304 (for example, but not limited to, blades 340, 342, 344, and 346), as described in U.S. Pat. No. 10,519,016, to open a container. The entirety of U.S. Pat. No. 10,519,016 is incorporated herein by reference.

Figure 14:
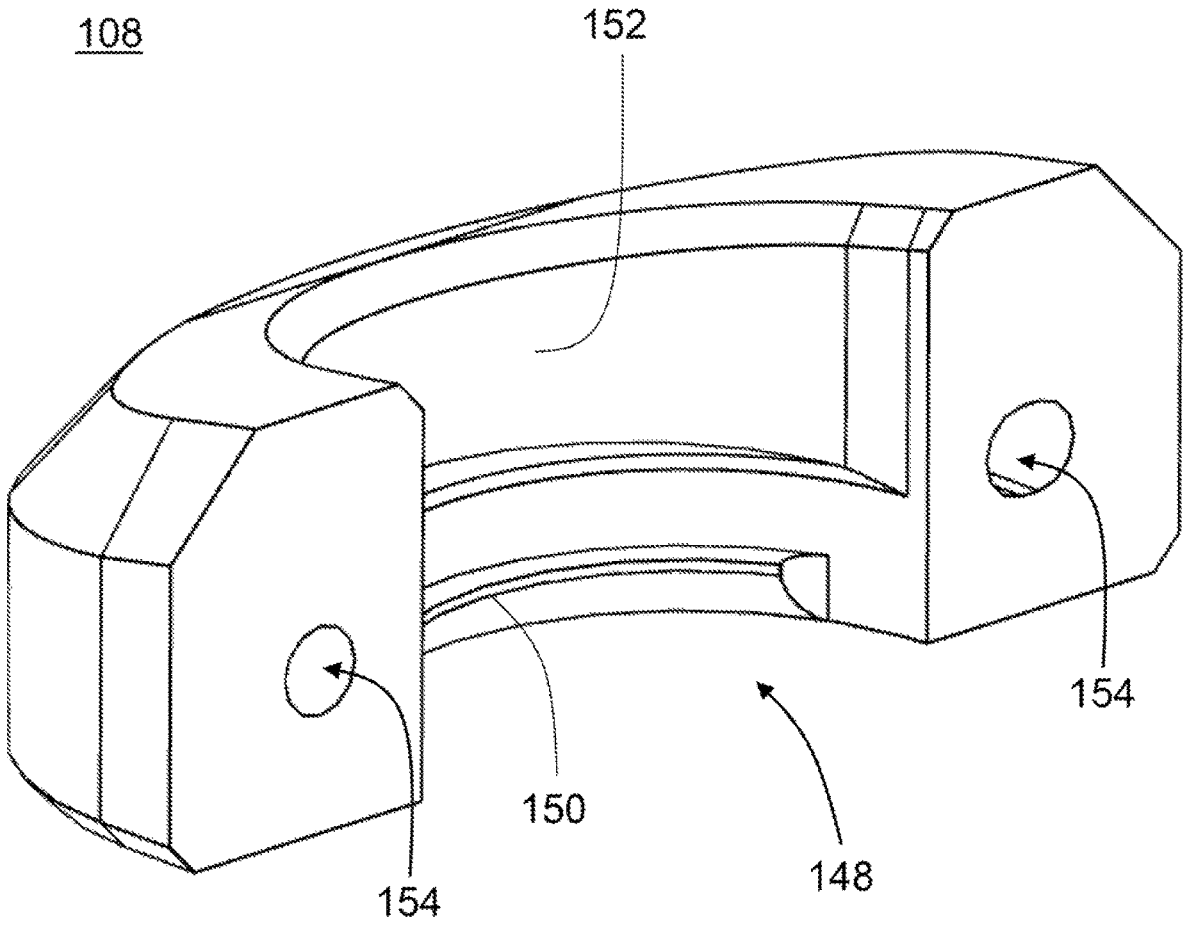
FIG. 14 illustrates an example engagement member.

The engagement member 108 is shown in FIG. 14. The engagement member 108 is configured to be translatably coupled to the upper base 112 to engage the container and retain the container as a top portion of the container is cut. The engagement member 108 defines a hollow 148 that is complementary to the hollow 130 of the upper base 112. A lip 150 extends outwards from a face 152 of the engagement member 108 defining the hollow 148. The lip 150 is configured to engage the top portion of the container. The engagement member includes bores 154 configured to receive the posts 138 to couple the engagement member 108 to the upper base 112.

The actuation mechanism 110 is configured to translate the rotational movement in direction $D_1$ of the handle 104 into downward movement direction $D_3$ of the cutter head 106 and cutting blade 105 and inward movement direction $D_2$ of the engagement member 108 (i.e., toward the upper base 112). The actuation mechanism 110 is shown, for example, in FIGS. 4, 6, 7B, 7D, and 7E. The actuation mechanism 110 includes the first member 156, an upper pivot 158, a coupler 160, a lower guide 162, and a translation guide 164.

Figure 7B:
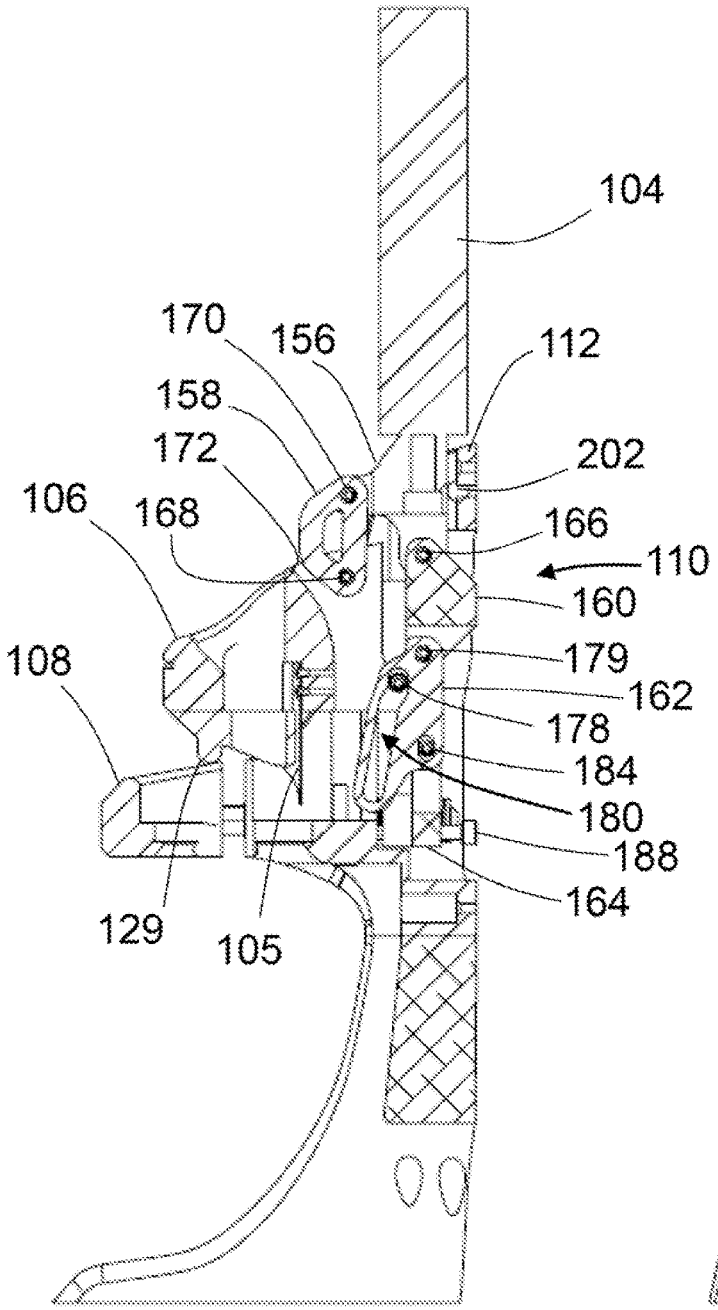
FIG. 7B illustrates a cross-sectional view taken along section A-A of the apparatus depicted in FIG. 7A.
Figure 7A:
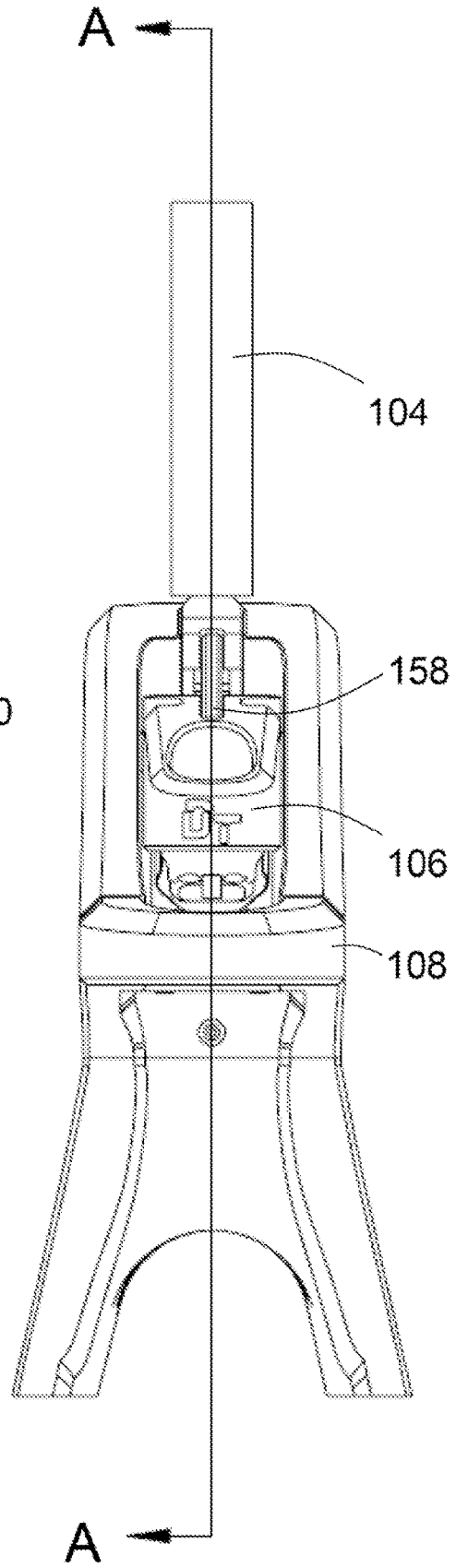
FIG. 7A is a front view of the apparatus of FIG. 1 in an unactuated position.
Figure 7D:
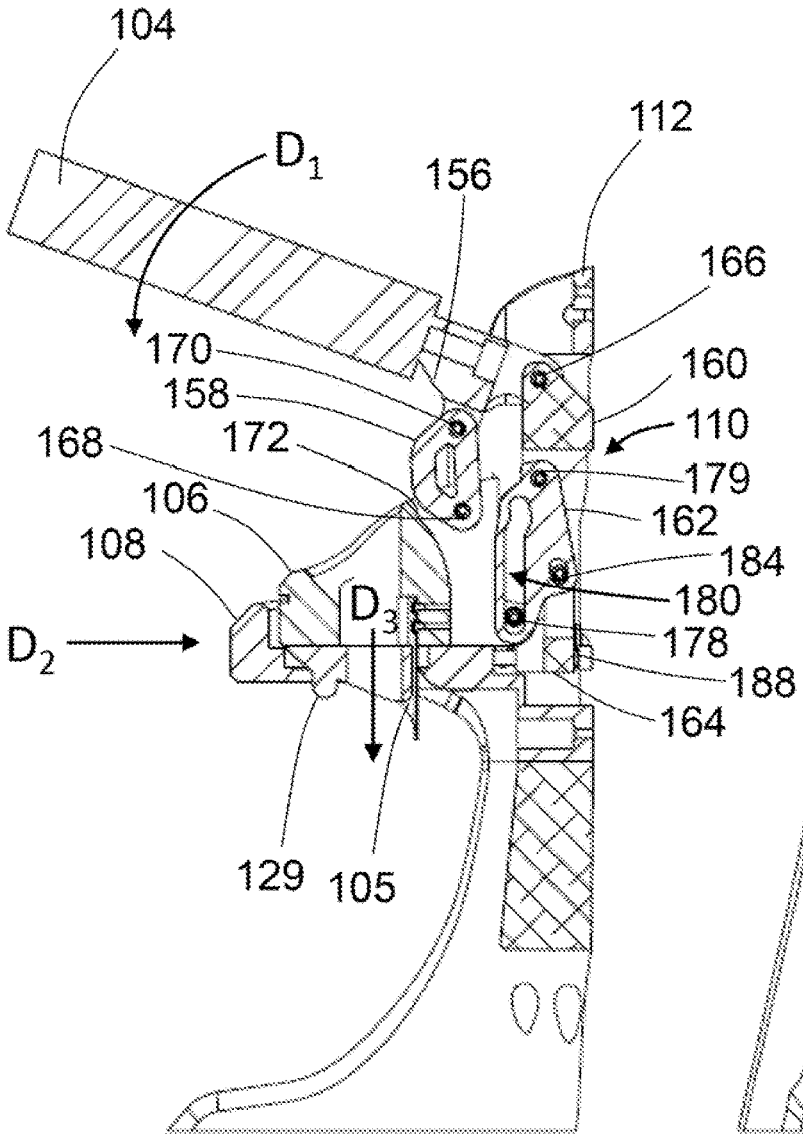
FIG. 7D illustrates a cross-sectional view taken along section B-B of the apparatus depicted in FIG. 7C.
Figure 7C:
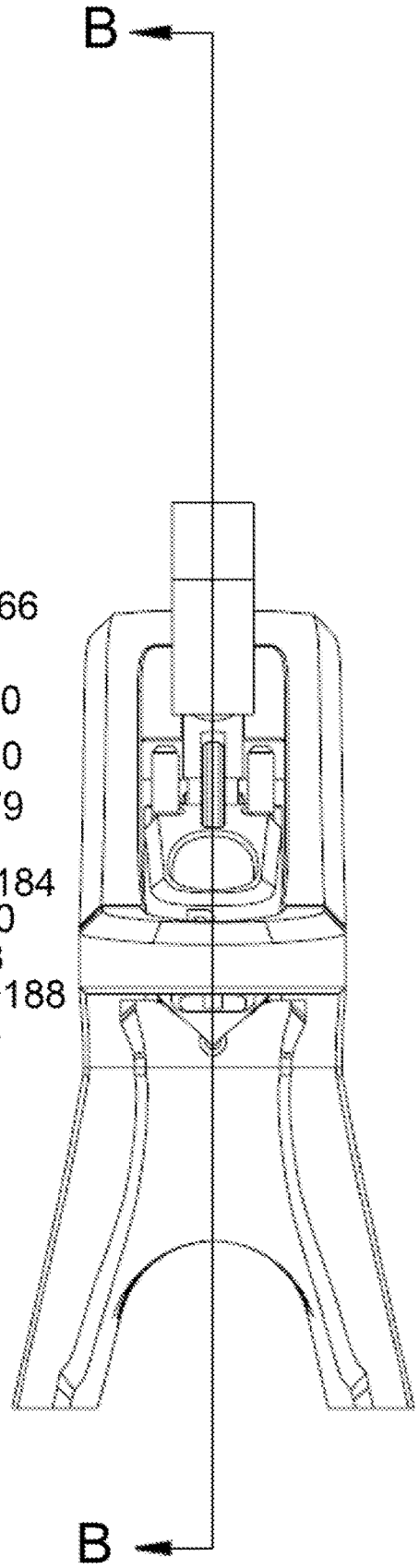
FIG. 7C is a front view of the apparatus of FIG. 1 in an actuated position.
Figure 7E:
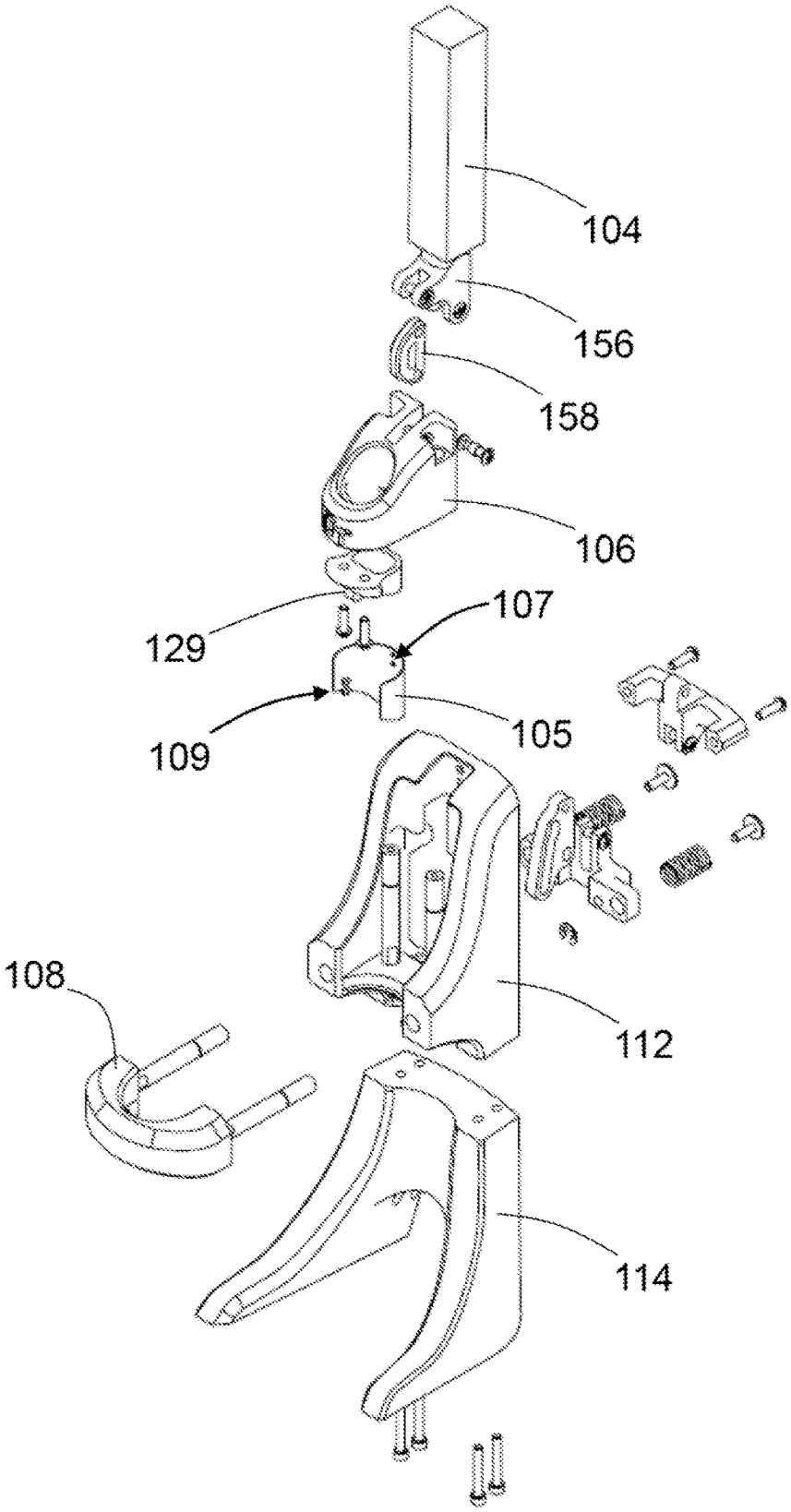
FIG. 7E illustrates an exploded view of the apparatus of FIG. 1.
Figure 8:
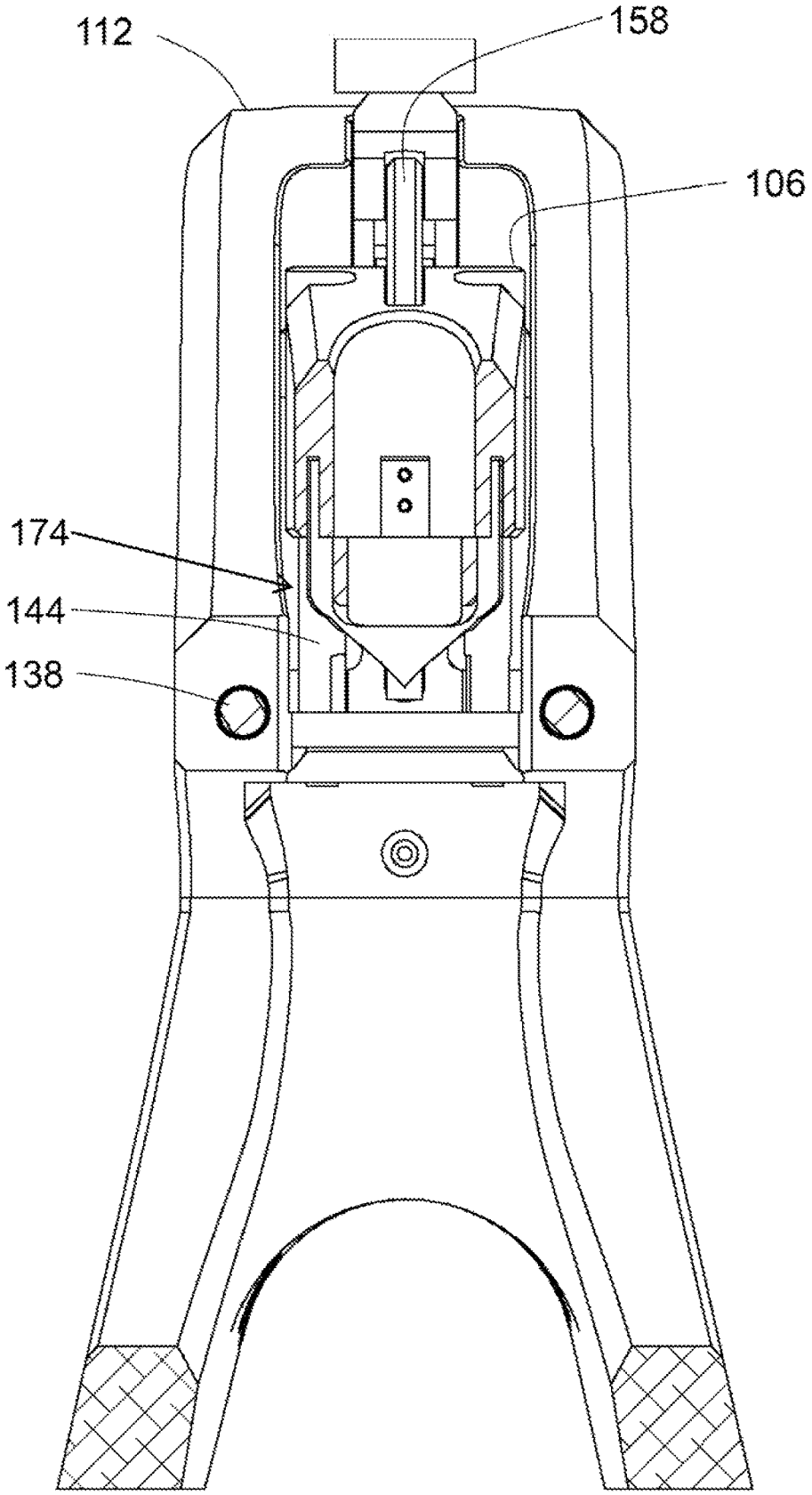
FIG. 8 illustrates a front view of an upper base and cross-sectional front view of a cutter head.

As shown in FIGS. 7B and 7D, the first member 156 is coupled to the handle 104 (e.g., via a fastener). As a result, when a user rotates the handle 104 in direction $D_1$, the first member 156 rotates in conjunction with the handle 104. The first member 156 is coupled to both the upper pivot 158 and the coupler 160. The coupler 160 is at least partially disposed in the rear cavity 126 of the upper base 112 and is coupled to the upper base 112 such that the coupler 160 is fixed in position (e.g., via fasteners attaching the coupler to the upper portion, shown in FIG. 6). As such, rotation of the handle 104 causes the first member 156 to rotate around a pin or screw 166 coupling the first member 156 to the coupler 160.

The upper pivot 158 is rotatably coupled to the cutter head 106 via pin or screw 168 and is rotatably coupled to first member 156 by pin or screw 170. The connection point of the first member 156 and the upper pivot 158 is positioned above and forward of the rotational axis of the first member 156. As such, rotation of the handle 104 and the first member 156 causes the upper pivot 158 to rotate forward but also to translate downward. This downward movement of the upper pivot 158 causes downward movement of the cutter head 106 and the cutting blade 105 in direction $D_3$ to cut the surface of the beverage container. As the upper pivot 158 rotates forward, it may come into contact with a face 172 of the cutter head 106 to restrict further rotation of the upper pivot 158 relative to the cutter head 106. As such, further rotation of the handle 104 by the user causes the upper pivot 158 and the cutter head 106 to move downward direction $D_3$ to cut the container. Moreover, the protrusion 129 contacts another portion of the container, and moves downward direction $D_3$ to push the cut portion of the top surface of the container into the container.

Figure 10:
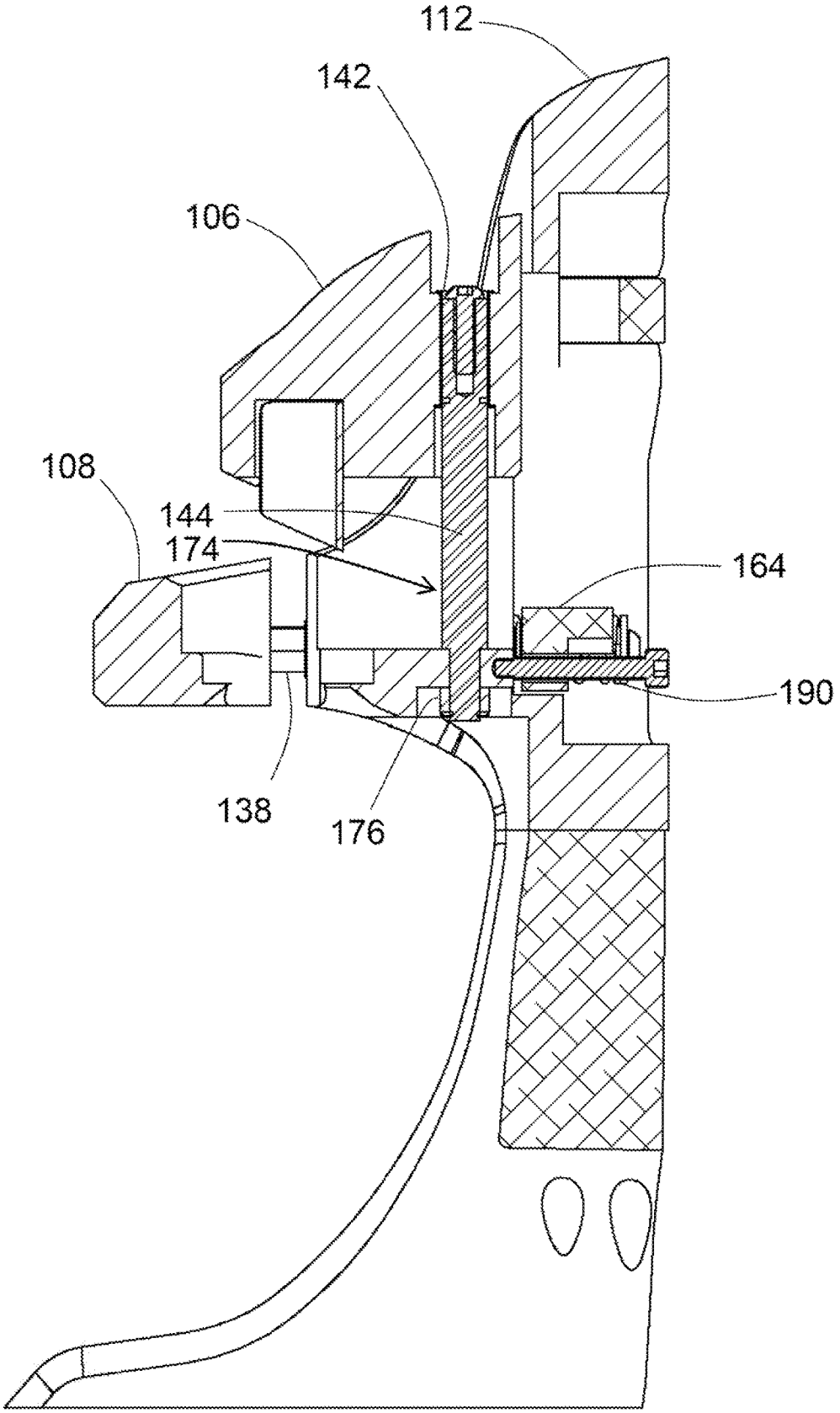
FIG. 10 illustrates a side cross-sectional view of the upper base.

As shown, for example, in FIG. 10, the motion of the cutter head 106 is guided by posts 144 extending through bores 142. A biasing member 174 (e.g., a compression spring), as shown, for example, in FIG. 6, may be provided around the posts 144 to bias the cutter head 106 toward an upper position. Hence, the user must overcome the spring force to move the cutter head 106 downward. The posts 144 are coupled at one end to the upper base 112 (e.g., via nut 176) and extend through the bores 142 in the cutter head 106.

Figure 19:
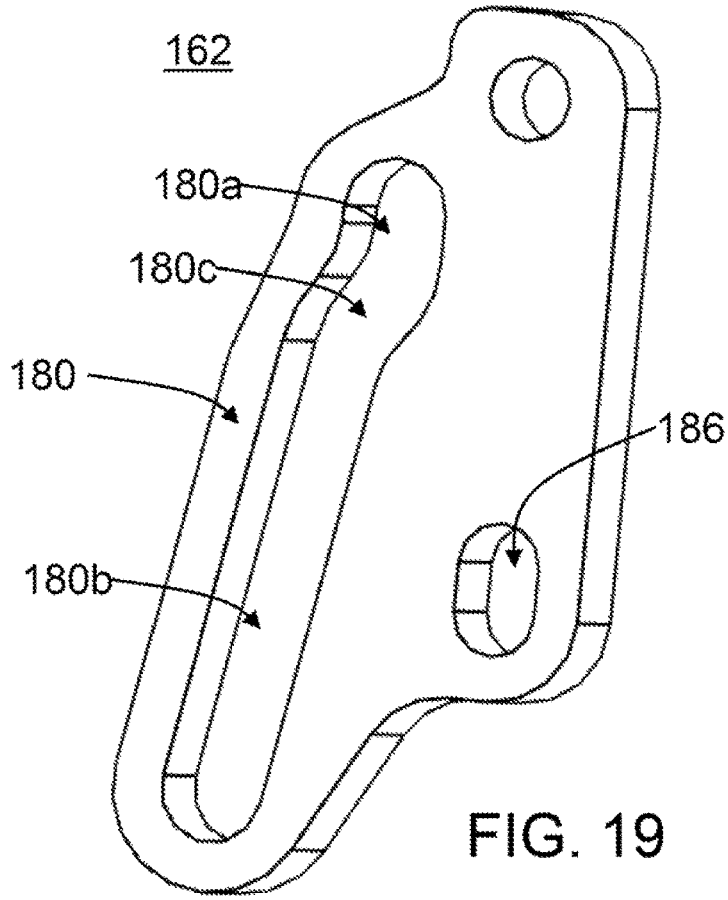
FIG. 19 illustrates a detailed view of a lower guide.
Figure 20:
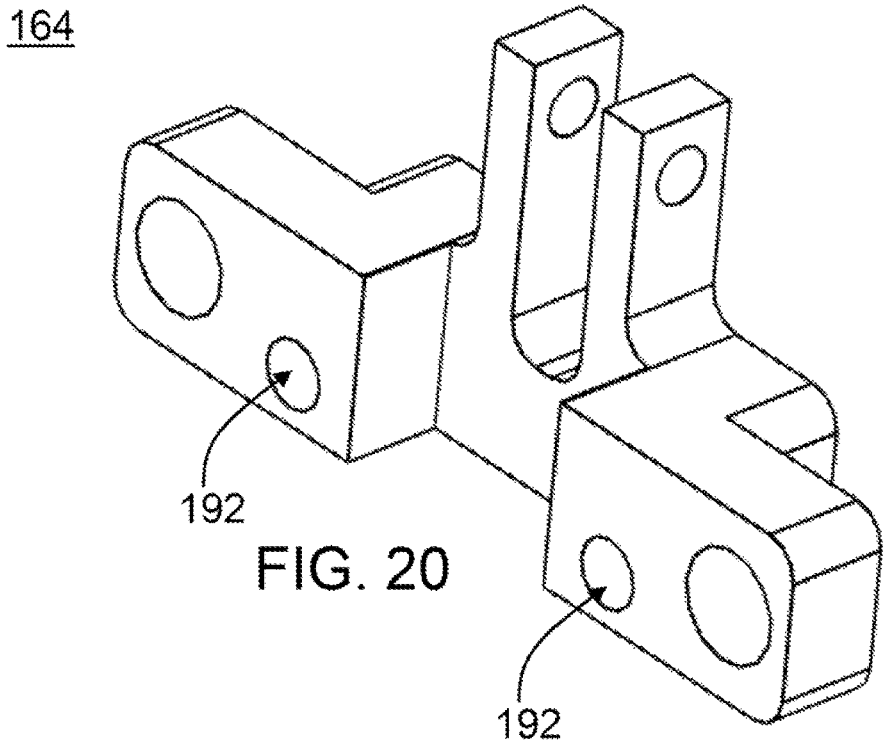
FIG. 20 illustrates a detailed view of a translation guide.
Figure 21:
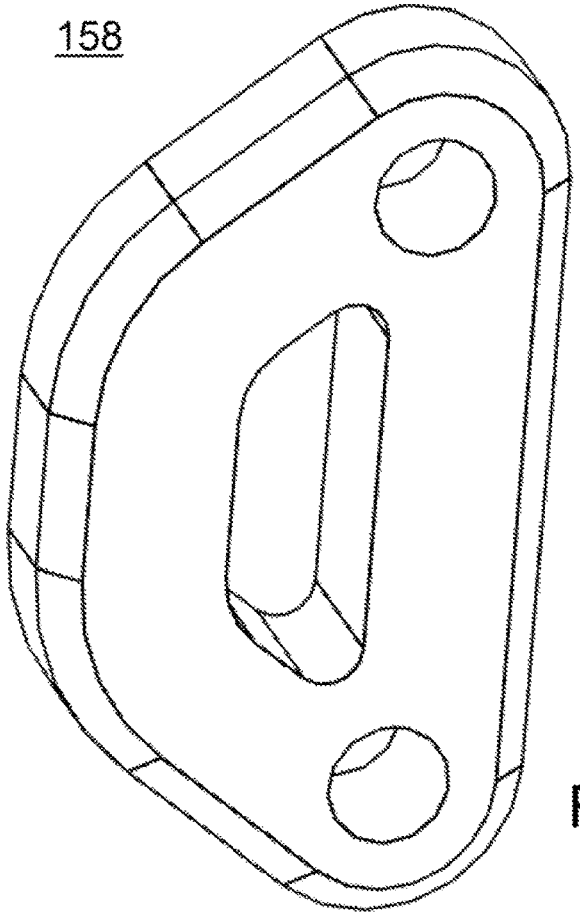
FIG. 21 illustrates a detailed view of an upper pivot.

The cutter head 106 is also coupled to the lower guide 162 via a pin or screw 178 extending through the lugs 140 of the cutter head 106. As shown best in FIGS. 7B and 7D, the pin or screw 178 is disposed in a track 180 of the lower guide 162. As shown in FIGS. 7B and 7D and the detailed view of the lower guide 162 in FIG. 19, the track 180 includes an upper portion 180*a*, a lower portion 180*b*, and a connecting portion 180*c* extending between the upper portion 180*a* and the lower portion 180*b*. During operation of the apparatus 100, the pin or screw 178 translates within the track 180. During the initial portion of operation of the apparatus 100 (i.e., rotation of the handle 104), the pin or screw 178 travels downward in the upper portion 180*a* of the track 180. During this portion of operation, the lower guide 162 remains substantially stationary. Continued downward movement of the cutter head 106 causes the pin or screw 178 to enter into the connecting portion 180*c* of the track 180. As the pin or screw 178 moves through the connecting portion 180*c*, the lower guide 162 rotates backward, around a pin or screw 182 connecting the lower guide 162 to the coupler 160. The rotation of the lower guide 162 causes the translation guide 164 to move backward. This backward movement of the translation guide 164 pulls the engagement member 108 inward to engage the container, as described herein. After the pin or screw 178 passes through the connecting portion 180*c* of the track 180, the pin or screw 178 enters the lower portion 180*c* of the track 180. As the user continues to rotate the handle 104 in direction $D_1$, the cutter head 106 moves downward in direction $D_3$ and the pin or screw 178 moves downward through the lower portion 180*b* of the track 180, which at this point is generally vertically oriented. The pin or screw 184 connecting the lower guide 162 and the translation guide 164 may be positioned in a slot 186 in the lower guide 162 to accommodate the relative movement of the lower guide 162 and the translation guide 164.

The lower guide 162 is attached to the coupler 160 using a pin or screw 179 such that the lower guide 162 can rotate with respect to the coupler 160 around the pin or screw 179.

Figure 9:
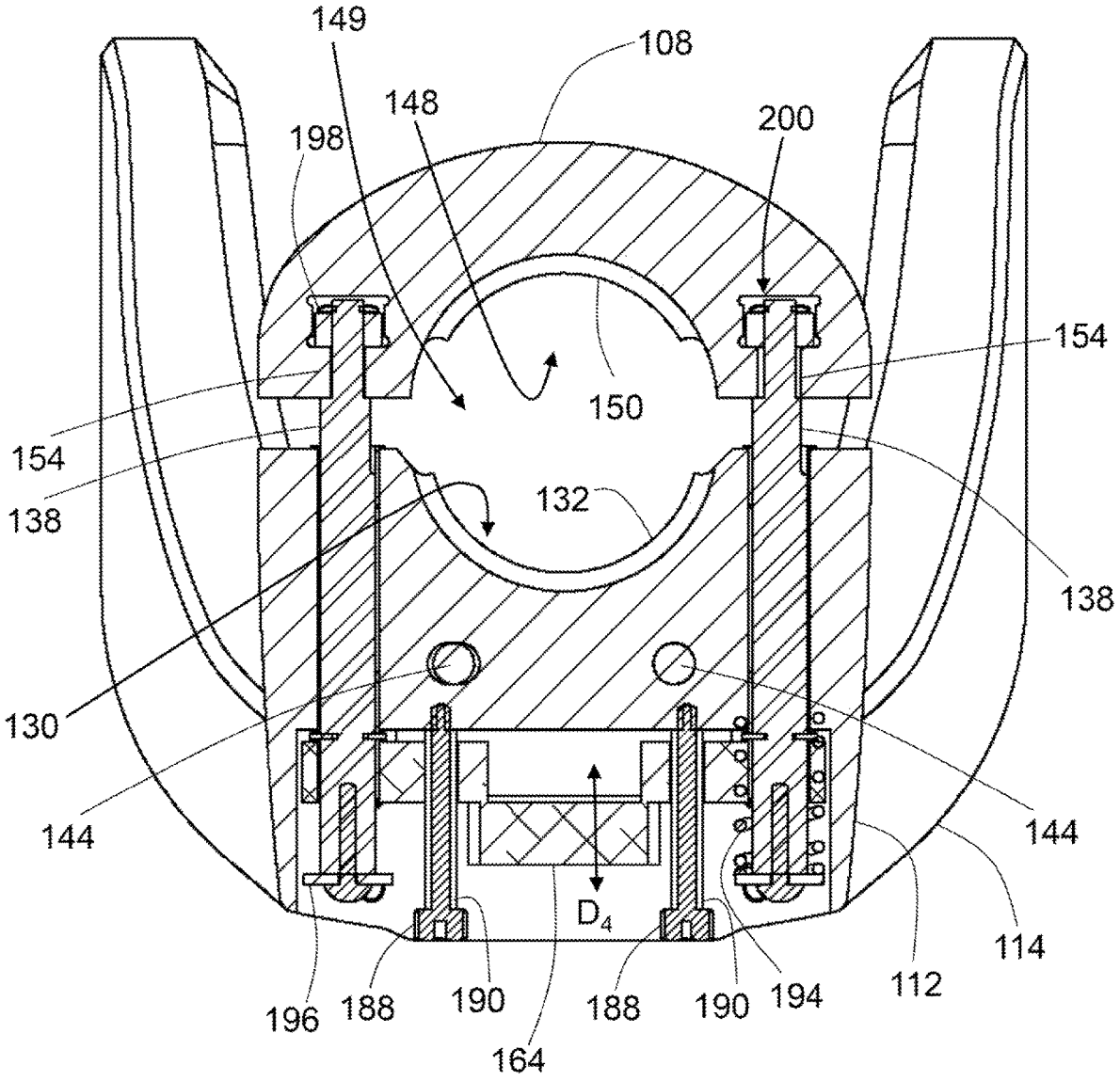
FIG. 9 illustrates a top cross-sectional view through an example engagement member, posts, and translation guide.

FIG. 9 shows a top cross-sectional view through the engagement member 108, the posts 138, and the translation guide 164. The translation guide 164 is coupled to the upper base 112 via fasteners 188. The translation guide 164 is able to translate in direction $D_4$ along the fasteners 188 as a result of the movement of the lower guide 162. Biasing members 190 (e.g., compression springs) may be positioned around the fasteners 188 to bias the translation guide 164 toward a forward position (i.e., an unactuated state) so that the engagement member 108 is biased toward a forward position (i.e., an unactuated state) (shown in FIG. 9). The posts 138 pass through bores 192 in the translation guide 164. The posts 138 can be fixedly coupled to the translation guide 164 such that translation of the translation guide 164 is directly converted to translation of the posts 138 and, thereby, the engagement member 108. Alternatively, as shown in the embodiment of FIG. 9, translation of the translation guide 164 may be translated to translation of the posts 138 via biasing members 194. As a result, the posts 138 (and the engagement member 108) may not translate to the same extent as the translation guide 164. This may allow the apparatus 100 to accommodate variations in the size and/or contour of the container. In other words, as the translation guide 164 moves backward away from the forward position (i.e., into an actuated state), the posts 138 and engagement member 108 moves backward with the translation guide 164 until the engagement member 108 engages the container in the container receiving area 149, defined by the hollows 130 and 148. Once the container is securely held between the lips 132, 150, translation of the engagement member 108 may be restricted and the biasing members 194 may compress instead of forcing further translation of the engagement member 108. The biasing members 194 may be positioned between a washer or flanged fastener head 196 and the translation guide 164. In one or more cases, the apparatus 100 may lock the container between lips 132, 150 such that the container may not be removed from the apparatus 100 until the handle 104 is moved or begins to move to the unactuated state.

The posts 138 may be attached to the engagement member 108, via nuts 198, on end portions opposition the translation guide 164. As shown in the bottom view of FIG. 5, the nuts 198 may be inserted into slots 200 in the engagement member 108, and the posts 138 may be fastened to the nuts 198. In this way, the posts 138 and the engagement member 108 are held together and translate together during operation of the apparatus 100.

The apparatus 100 may further include a detent 202 coupled to the upper base 112 and in contact with the first member 156 to hold the first member 156 and the handle 104 in the upward, vertical position (i.e., the unactuated position) when the apparatus 100 is not in use.

Because rotation of the handle 104 causes both downward movement of the cutter head 106 and the cutting blade 105 in the direction $D_3$ and inward movement of the engagement member 108 in a direction $D_2$, the apparatus 100 is easy to use. For example, the container is positioned in the hollows 130, 148 with one hand and another hand operates the handle 104 by moving the handle into the actuated position. As the handle 104 is rotated downward in the direction $D_1$, the lips 132, 150 engage the container and hold the container in place while the cutting blade 105 pierces and cuts a portion of a top surface of the container. As the cutting blade 105 cuts the portion of the container, the cutting blade 105 may simultaneously fold the edges of the cut portions of the container, leaving little to no sharp edges on the container, and press the cut portion of the top surface into the container. Further, as the cutting blade 105 cuts the portion of the container, the protrusion 129 contacts another portion of the container, and pushes the cut portion of the top surface of the container into the container. The Moreover, by creating a larger opening in the container than conventional container opening devices, the user may smell the full aroma of the container contents without inhibiting the user's sense of taste.

The various embodiments described above are provided by way of illustration only and should not be construed to limit the claims attached hereto. Those skilled in the art will readily recognize various modifications and changes that may be made without following the example embodiments and application illustrated are described herein, and without departing from the true spirit and scope of the following claims.

What is claimed is:

1. A container opener, comprising:

a handle operatively coupled to a base;

the base comprising:

a first surface sized to receive a portion of a container;

a cutter head having a blade; and an actuating mechanism operatively coupled to the handle and cutting head;

an engagement member having a second surface sized to receive another portion of the container, a shape of the second surface being complimentary to a shape of the first surface of the base, wherein the actuating mechanism is configured to translate a rotational movement of the handle to a movement of the cutter head in a vertical direction of the container opener and to a movement of the second surface in a horizontal direction of the container opener.

2. The container opener of claim 1, further comprising a support coupled to the base, the support comprising feet configure to rest on a horizontal surface.

3. The container opener of claim 1, wherein a rear surface of the base is configured to be mounted to a vertical surface.

4. The container opener of claim 1, wherein the base further comprises a rear cavity sized to receive one or more portions of the actuating mechanism.

5. The container opener of claim 1, wherein the first surface of the base and the second surface of the engagement member define a hollow, the first surface and the second surface each comprising a lip to position the container in the hollow.

6. The container opener of claim 1, wherein the cutter head further comprises a protrusion extending from a bottom of the cutter head, the protrusion being configured to push a cut portion of the container into the container.

7. The container opener of claim 1, wherein the blade is removably coupled to the cutter head.

8. The container opener of claim 1, wherein the blade comprises a piercing end disposed on a distal end of the blade, the piercing end having a sharp pointed end capable of piercing a portion of a surface of the container.

9. The container opener of claim 8, wherein the pointed end extends from a tip of the blade to a folding edge disposed on a proximal end of the piercing end.

10. The container opener of claim 9, wherein the folding edge is formed in a shape configured to fold inward a cut portion of the surface of the container.

11. The container opener of claim 1, wherein the blade is formed in a cylindrical shape having at least one pointed end.

12. The container opener of claim 1, wherein:

the engagement member and the base are translatably coupled to one another via posts, and distal ends of the posts are coupled to a translation guide, such that when the first surface and the second surface engage a container, translation of the engagement member is restricted from moving towards the base.

13. The container opener of claim 1, wherein the actuating mechanism is configured to translate a downward rotational movement of the handle to actuate the engagement member towards the base to engage the container and to actuate the cutter head in a downward direction such that the blade pierces a surface of the container.

14. The container opener of claim 13, wherein a biasing member is configured to bias the engagement member away from the base, such that an upward rotational movement of the handle allows the biasing member to move the engagement member away from the base.

15. A device comprising:

a handle operatively coupled to a base;

the base comprising:

a first surface and a second surface forming a hollow sized to receive a portion of a container;

a cutter head having a blade; and an actuating mechanism operatively coupled to the handle and cutting head, wherein the actuating mechanism is configured to translate a rotational movement of the handle to a movement of the cutter head in a vertical direction of the container opener and to a movement of the second surface in a horizontal direction towards the first surface.

16. The device of claim 15, wherein the actuating mechanism is configured to translate a downward rotational movement of the handle to actuate the second surface towards the base to engage the container and to actuate the cutter head in a downward direction such that the blade pierces a surface of the container.

17. The device of claim 16, wherein a biasing member is configured to bias the second surface away from the base, such that an upward rotational movement of the handle allows the biasing member to move the second surface away from the base.

18. The device of claim 15, wherein the first surface and the second surface each comprise a lip to position the container in the hollow.

19. The device of claim 15, wherein:

the blade comprises a piercing end having a pointed end disposed on a distal end of the blade and folding edges disposed on a proximal end of the piercing end, the piercing end formed in a shape capable of piercing a portion of a surface of the container, and the folding edges formed in a shape configured to fold inward a cut portion of the surface of the container.

20. A method comprising:

positioning a container within a hollow of a base of a device, the hollow being formed by a first surface and a second surface of the base;

rotating a handle of the device in a first downward direction causing:

the first surface and second surface to engage and position the container within the hollow, and a cutter head of the device to translate in a second downward direction to pierce a surface of the container and to fold a cut portion of the surface inward; and rotating the handle in a first upward direction causing:

the first surface and second surface to disengage the container, and the cutter head to translate in a second upward direction, the second upward direction being opposite the second downward direction.

* * * * *